US007664229B2

(12) United States Patent
Okada et al.

(10) Patent No.: US 7,664,229 B2
(45) Date of Patent: Feb. 16, 2010

(54) X-RAY TUBE AND X-RAY SOURCE INCLUDING SAME

(75) Inventors: Tomoyuki Okada, Hamamatsu (JP); Tutomu Inazuru, Hamamatsu (JP)

(73) Assignee: Hamamatsu Photonics K.K., Hamamatsu-shi, Shizuoka (JP)

( * ) Notice: Subject to any disclaimer, the term of this patent is extended or adjusted under 35 U.S.C. 154(b) by 78 days.

(21) Appl. No.: 12/088,890

(22) PCT Filed: Oct. 4, 2006

(86) PCT No.: PCT/JP2006/319872

§ 371 (c)(1),
(2), (4) Date: May 16, 2008

(87) PCT Pub. No.: WO2007/043412

PCT Pub. Date: Apr. 19, 2007

(65) Prior Publication Data

US 2009/0154651 A1 Jun. 18, 2009

(30) Foreign Application Priority Data

Oct. 7, 2005 (JP) ..... 2005-295704

(51) Int. Cl.
*H01J 35/14* (2006.01)
*H01J 35/30* (2006.01)
*H01J 35/08* (2006.01)

(52) U.S. Cl. ..... 378/138; 378/121; 378/137; 378/143

(58) Field of Classification Search ..... 378/121, 378/136, 137, 138, 143
See application file for complete search history.

(56) References Cited

U.S. PATENT DOCUMENTS 5,077,771 A 12/1991 Skillicorn et al.
5,563,923 A 10/1996 Okada et al.

(Continued)

FOREIGN PATENT DOCUMENTS

JP 50-11690 2/1975

(Continued)

*Primary Examiner*—Allen C. Ho
(74) *Attorney, Agent, or Firm*—Drinker Biddle & Reath LLP

(57) ABSTRACT

The present invention relates to an X-ray tube, having a structure enabling capturing of a clear magnified transmission image and enabling increase of a magnification factor of the magnified transmission image, and an X-ray source including the X-ray tube. In the X-ray tube, X-rays are generated by making electrons from an electron gun incident onto an X-ray target of an anode, disposed inside an anode housing unit, and the generated X-rays are taken out from an X-ray emission window. In particular, the anode housing unit has a pair of conductive flat portions disposed parallel to a reference plane, orthogonal to an electron incidence surface of the X-ray target, and so as to sandwich the X-ray target. The reference plane contains a first reference line, joining an electron emission exit center of the electron gun and an electron incidence surface center of the X-ray target, and a second reference line, being a straight line intersecting the first reference line on the electron incidence surface of the X-ray target and joining the electron incidence surface center and an X-ray emission window center.

5 Claims, 22 Drawing Sheets

U.S. PATENT DOCUMENTS 6,229,876 B1 5/2001 Enck et al.
6,381,305 B1 4/2002 Okada et al.
6,385,294 B2 * 5/2002 Suzuki et al. ..... 378/136
6,526,122 B2 * 2/2003 Matsushita et al. ..... 378/138
7,072,439 B2 * 7/2006 Radley et al. ..... 378/47
7,085,353 B2 * 8/2006 Yoshiyama et al. ..... 378/123
7,340,036 B2 * 3/2008 Tomita et al. ..... 378/143
7,466,799 B2 * 12/2008 Miller ..... 378/140

FOREIGN PATENT DOCUMENTS

JP 54-35078 10/1979
JP 2001-23557 1/2001

* cited by examiner (a)

(b)

(a)

(b)

X-RAY TUBE AND X-RAY SOURCE INCLUDING SAME

TECHNICAL FIELD

The present invention relates to an X-ray tube taking out X-rays generated within a container toward an exterior from an X-ray emission window, and an X-ray source including the X-ray tube.

BACKGROUND ART

X-rays are electromagnetic waves that are highly transmitted through objects and are frequently used for nondestructive, noncontact observation of internal structures of objects. Normally with an X-ray tube, X-rays are generated by making electrons, emitted from an electron gun, incident on an X-ray target. As described in Patent Document 1, with an X-ray tube, a tubular member, housing an electron gun, is mounted onto a housing member that houses a target. Electrons, emitted from the electron gun, are made incident on the target and X-rays are generated from the target. The generated X-rays are transmitted through an X-ray emission window of the X-ray tube and irradiated onto a sample disposed at an exterior. The X-rays transmitted through the sample are captured as a magnified transmission image by any of various X-ray imaging means.

Patent Document 1: U.S. Pat. No. 5,077,771

DISCLOSURE OF THE INVENTION

Problems that the Invention is to Solve

The present inventors have examined the conventional X-ray tubes, and as a result, have discovered the following problems. That is, ovalization of a shape of an X-ray generation region as viewed from the X-ray emission window (hereinafter referred to as the "X-ray generation shape") can be cited as a cause of the captured magnified transmission image becoming unclear. The X-ray generation shape is due to a cross-sectional shape of an electron beam at a point of incidence of electrons onto the X-ray target (hereinafter referred to as the "electron incidence shape"). That is, the closer the electron incidence shape is to being circular, the closer the X-ray generation shape is to being circular. Thus, in the X-ray tube described in Patent Document 1, by disposing a shield (hood electrode) at a tip of an anode, including the X-ray target, and making the hood electrode have a function of adjusting the electron incidence shape, the X-ray generation shape is made as circular as possible.

On the other hand, in order to increase a magnification factor of the captured magnified transmission image, a distance (FOD: Focus Object Distance), from a position of incidence of electrons onto the X-ray target (focal point position of X-rays) to the X-ray emission window, must be made short. However, if a hood electrode is disposed at the tip of the anode, the FOD becomes long. Thus, in the conventional X-ray tube there was the issue that whereas if the hood electrode is not provided, an adequate definition of the magnified transmission image cannot be obtained, if the hood electrode is provided, increase of the magnification factor of the magnified transmission image is difficult.

The present invention has been developed to eliminate the problems described above. It is an object of the present invention to provide an X-ray tube having a structure that is enable capturing of a clear magnified transmission image and is enable increase of a magnification factor of the magnified transmission image, and an X-ray source including the X-ray tube.

Means for Solving the Problems

An X-ray tube according to the present invention comprises an anode housing unit, an anode having an X-ray target, and an electron gun. The anode housing unit has an X-ray emission window for taking out X-rays generated in an internal portion to an exterior. The anode is fixed to a predetermined position inside the anode housing unit. The electron gun emits electrons toward the X-ray target to generate X-rays in a direction from the X-ray target toward the X-ray emission window. In particular, the anode housing unit has a pair of conductive flat portions disposed so as to oppose each other while sandwiching an electron incidence surface of the X-ray target. The pair of conductive flat portions are disposed in parallel to a reference plane which contains a first reference line, joining an electron emission exit center of the electron gun and an electron incidence surface center of the X-ray target, and a second reference line, being a straight line intersecting the first reference line on the electron incidence surface of the X-ray target and joining an X-ray emission window center and the electron incidence surface center of the X-ray target. The X-ray emission window, the electron incidence surface of the X-ray target, and the electron emission exit of the electron gun are preferably disposed so that the reference plane is orthogonal to the X-ray target.

Thus, in the present X-ray tube, the anode housing unit is provided with the pair of conductive flat portions disposed so as to oppose the reference plane in parallel in the state of sandwiching the electron incidence surface of the X-ray target. With this configuration, an electron incidence shape can be made closer to being circular by actions of an electric field formed across the electron incidence surface of the X-ray target and the electron gun. As a result, an X-ray generation shape can be made closer to being circular. A clear magnified transmission image can thus be obtained. Furthermore, because unlike the conventional X-ray tube, the use of a hood electrode is not required, an FOD can be made short. Thus, in the present X-ray tube, a magnification factor of the magnified transmission image can be increased.

In the X-ray tube according to the present invention, the anode housing unit may have a tubular head, onto which the electron gun is mounted, and an inner container (inner tube), mounted inside the head and in an interior of which the electron incidence surface of the X-ray target is disposed. In this case, the pair of conductive flat portions are preferably disposed in the inner tube. In this configuration, because the conductive flat portions are formed on the inner tube that is a separate member from the head, the forming of the pair of conductive flat portions is made easier in comparison to a case where the pair of conductive flat portions are formed directly on the head, onto which the electron gun housing unit is mounted.

In the X-ray tube according to the present invention, the anode may have a straight main body and a protruding portion, extending along an axis line of the main body from a tip of the main body. In this case, the electron incidence surface of the X-ray target is preferably formed on the protruding portion. In this configuration, because the protruding portion of the anode extends along the axis line of the straight main body and the electron incidence surface of the X-ray target is formed on the protruding portion, an electric field action by the protruding portion is added to enable the electron incidence shape to be made even closer to being circular.

Also, in the X-ray tube according to the present invention, the electron emission exit of the electron gun that faces the X-ray target preferably has a circular shape. In this case, it becomes even easier to make the electron incidence shape closer to being circular.

Furthermore, an X-ray source according to the present invention comprises the X-ray tube with the above-described structure (X-ray tube according to the present invention), and a power supply unit supplying a voltage for generating X-rays at the X-ray target toward the anode at which the X-ray target is disposed.

The present invention will be more fully understood from the detailed description given hereinbelow and the accompanying drawings, which are given by way of illustration only and are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the scope of the invention will be apparent to those skilled in the art from this detailed description.

Effects of the Invention

In accordance with the X-ray tube according to the present invention, capturing of a clear magnified transmission image and increase of a magnification factor of the magnified transmission image are enabled.

DESCRIPTION OF THE REFERENCE NUMERALS

Figure 1:
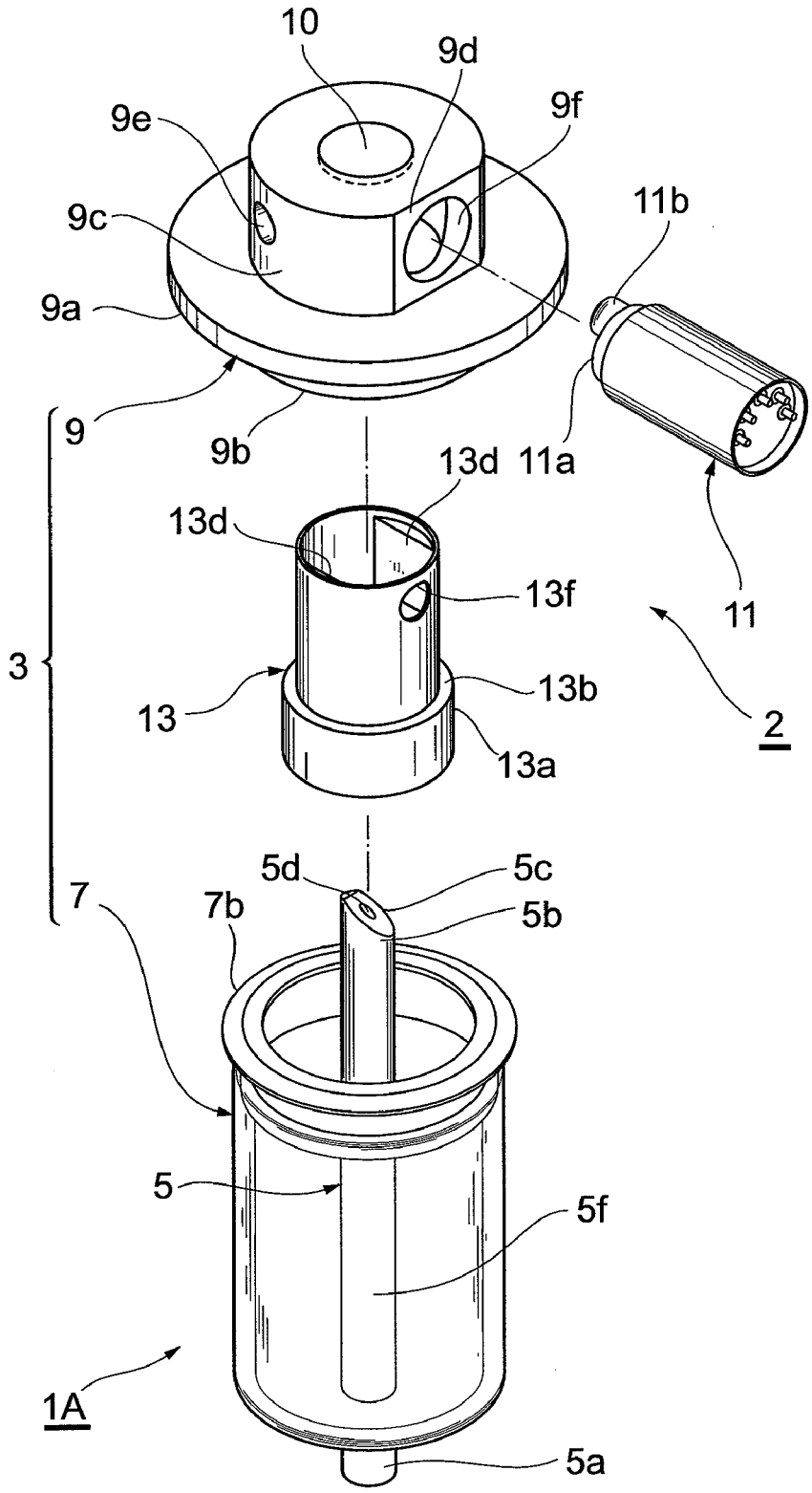
FIG. 1 is an exploded perspective view of an arrangement of a first embodiment of an X-ray tube according to the present invention.

1A, 1B, 1C . . . X-ray tube; 3 . . . vacuum enclosure (anode housing unit); 5, 40, 50 . . . anode; 5*d*, 47*b*, 52*c* . . . target; 5*f*, 41, 51 . . . main body; 9 . . . head; 13 . . . inner tube (inner container); 13*d* . . . conductive flat portion; 47, 52 . . . protruding portion; 5*e*, 47*d*, 52*d* . . . electron incidence surface; 15 . . . electron gun; 15*a* . . . electron emission exit; 10 . . . X-ray emission window; C1 . . . tube axis line; C2, C4, C5 . . . axis line of main body; 100 . . . X-ray source; 102 . . . power supply unit; 102A . . . insulating block; 102B . . . high voltage generating unit; 102C . . . high voltage line; 102D . . . socket; 103 . . . first plate member; 103A . . . screw insertion hole; 104 . . . second plate member; 104A . . . screw insertion hole; 105 . . . fastening spacer member; 105A . . . screw hole; 106 . . . metal tubular member; 106A . . . mounting flange; 106B . . . relief surface; 106C . . . insertion hole; 108 . . . conductive coating; 109 . . . fastening screw; 110 . . . high voltage insulation oil; XC . . . X-ray camera; SP . . . sample plate; P . . . observation point; and XP . . . X-ray generation point.

BEST MODES FOR CARRYING OUT THE INVENTION

In the following, embodiments of an X-ray tube and an X-ray source, including the X-ray tube, according to the present invention will be explained in detail with reference to FIGS. 1 to 15 and FIGS. 20 to 22. FIGS. 16 to 19 shall also be used as suitable to facilitate comparison with a conventional X-ray tube. In the description of the drawings, identical or corresponding components are designated by the same reference numerals, and overlapping description is omitted.

First Embodiment

Figure 2:
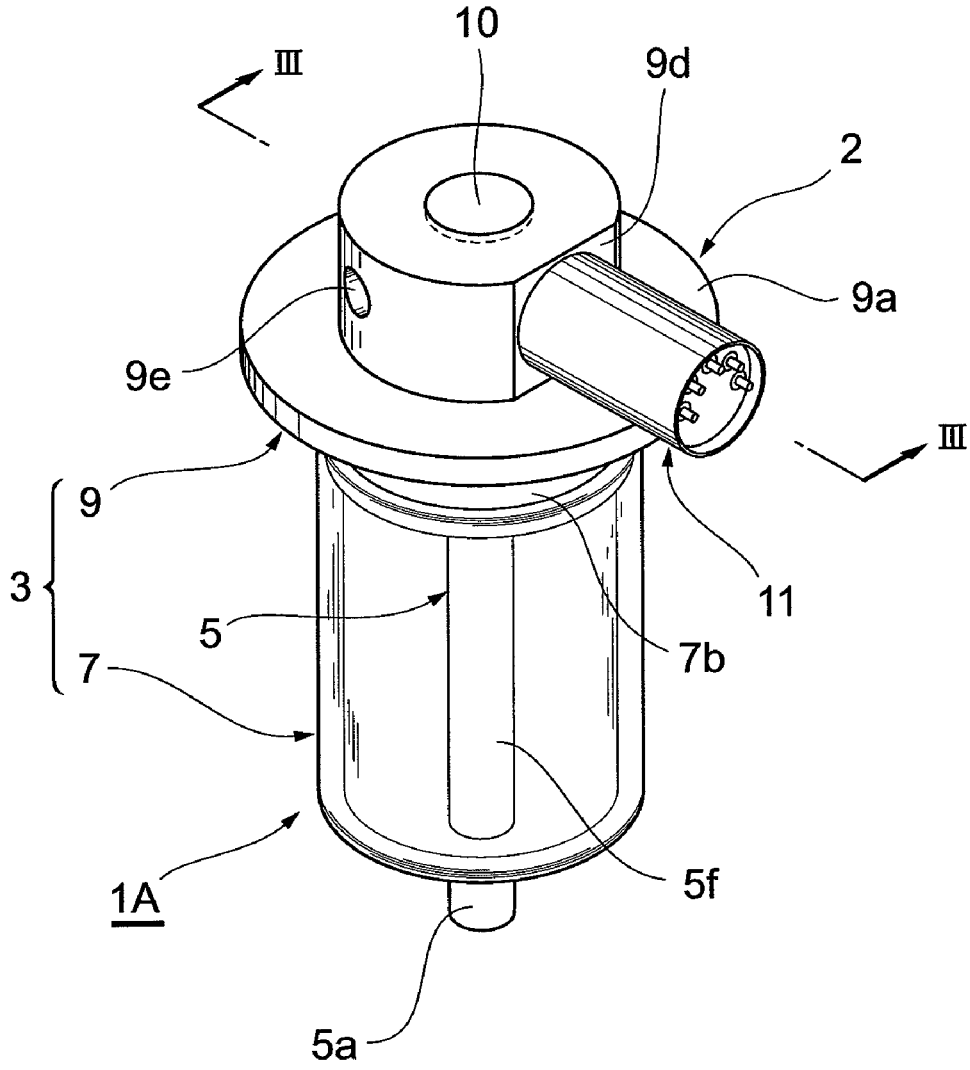
FIG. 2 is a perspective view of an overall arrangement of the X-ray tube according to the first embodiment.
Figure 3:
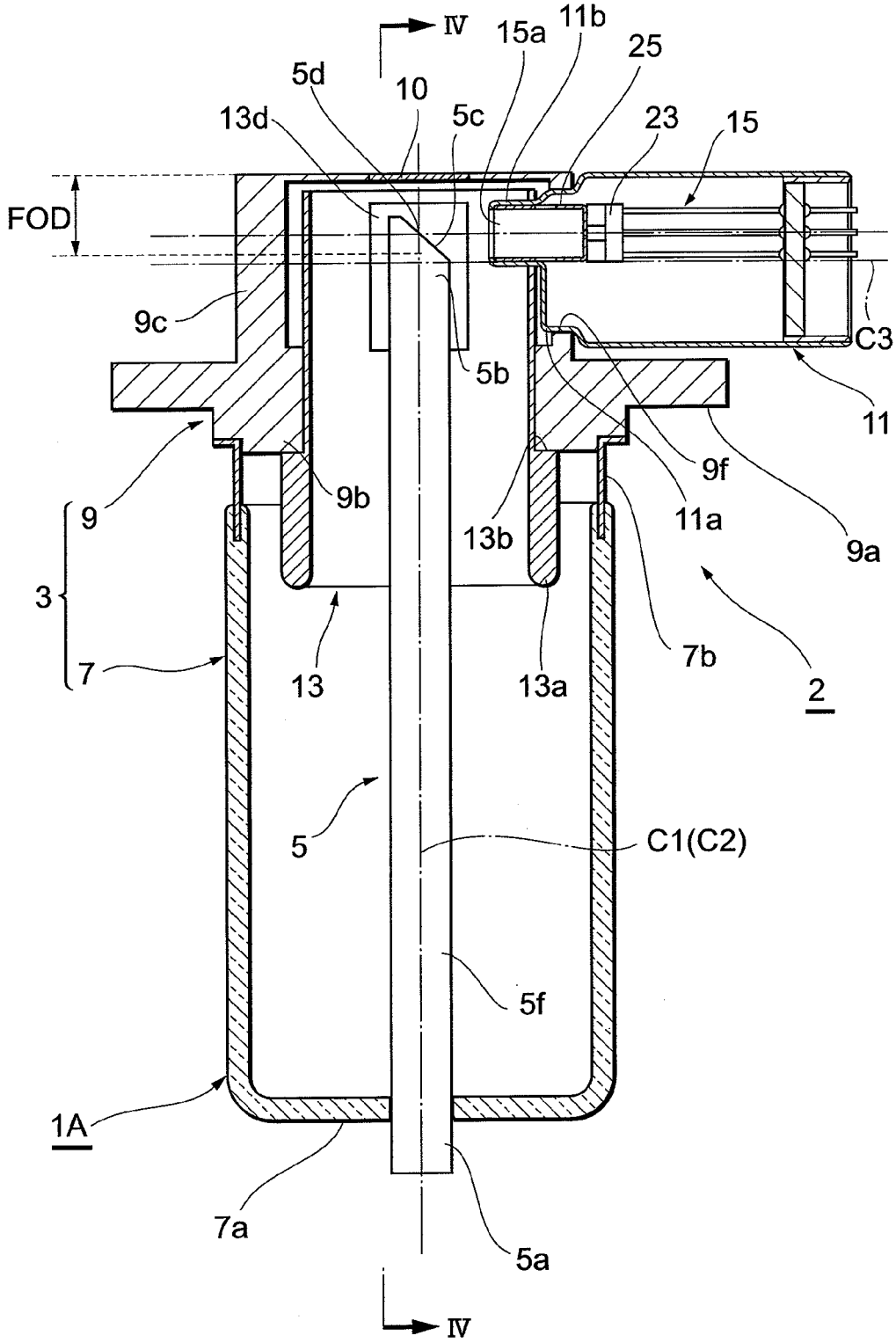
FIG. 3 is a sectional view of an internal structure of the X-ray tube according to the first embodiment taken on line III-III in FIG. 2.
Figure 4:
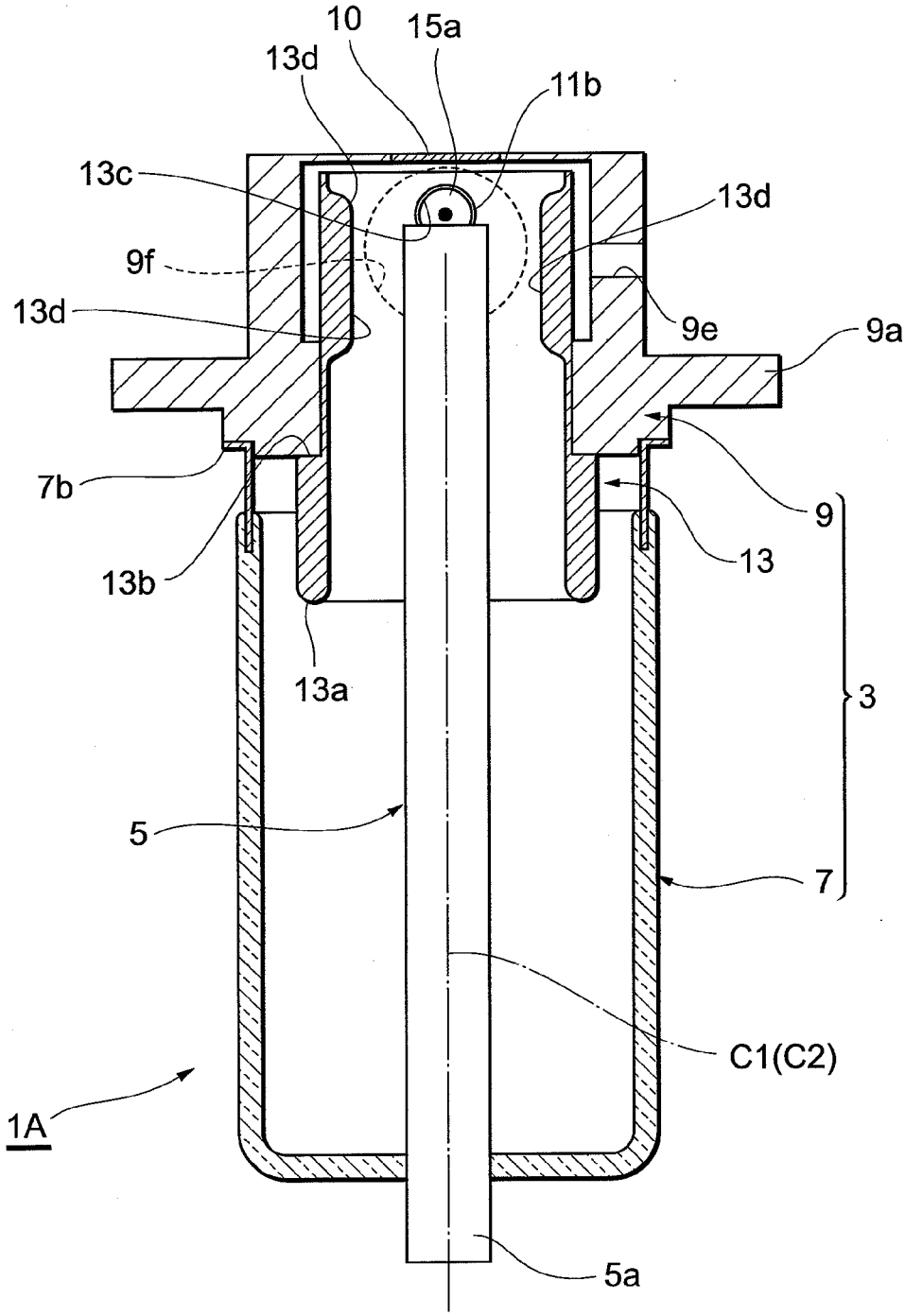
FIG. 4 is a sectional view of an internal structure of the X-ray tube according to the first embodiment taken on line IV-IV in FIG. 3.

First, an X-ray tube 1A according to a first embodiment shall be described with reference to FIGS. 1 to 8. FIG. 1 is an exploded perspective view of an arrangement of the first embodiment of the X-ray tube according to the present invention. FIG. 2 is a perspective view of an overall arrangement of the X-ray tube 1A according to the first embodiment. FIG. 3 is a sectional view of an internal structure of the X-ray tube 1A according to the first embodiment taken on line III-III of FIG. 2. FIG. 4 is a sectional view of an internal structure of the X-ray tube 1A according to the first embodiment taken on line IV-IV in FIG. 3.

Figure 5:
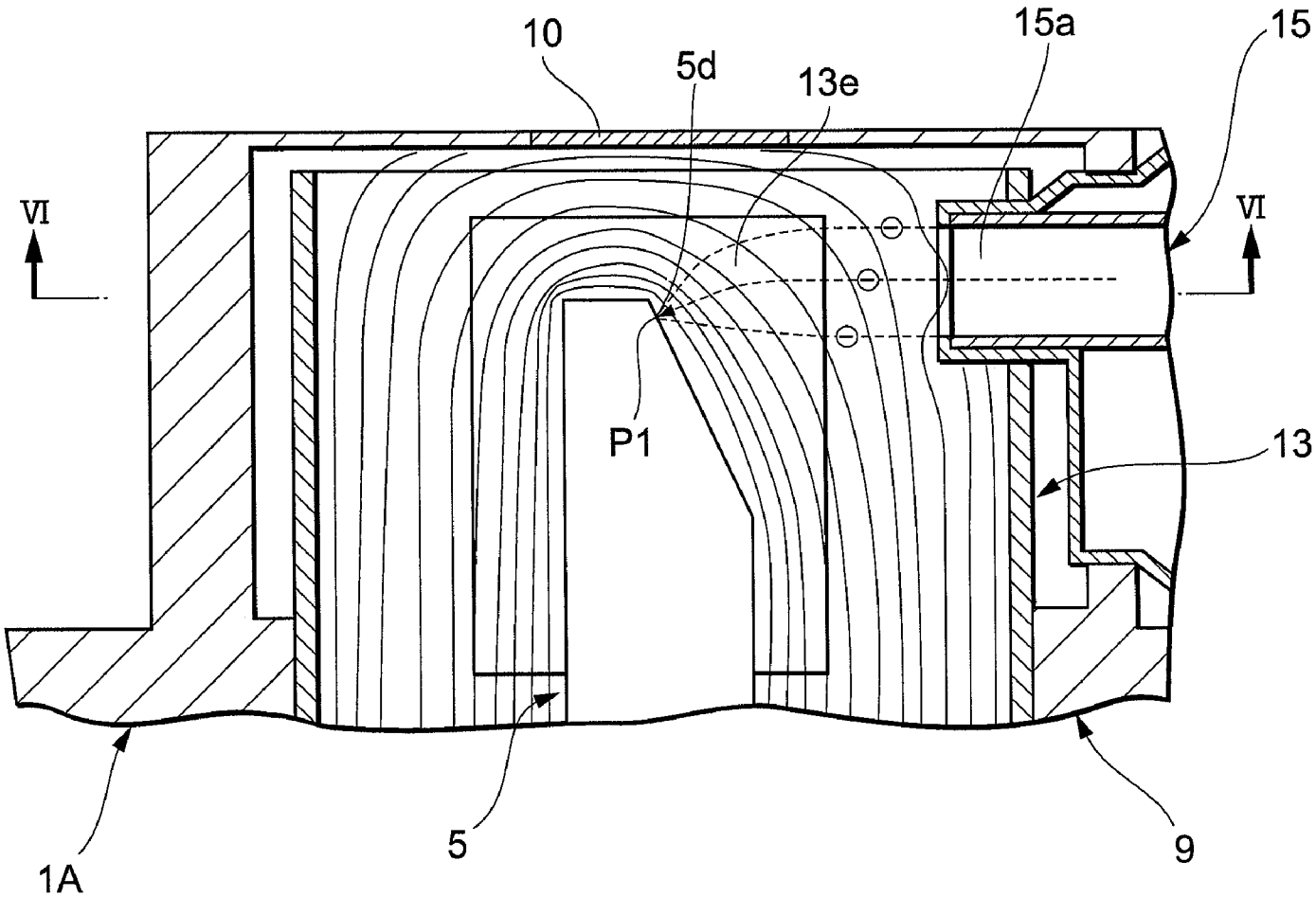
FIG. 5 is an enlarged sectional view for describing equipotential surfaces formed in a periphery of a protruding portion of an anode in the X-ray tube according to the first embodiment.
Figure 6:
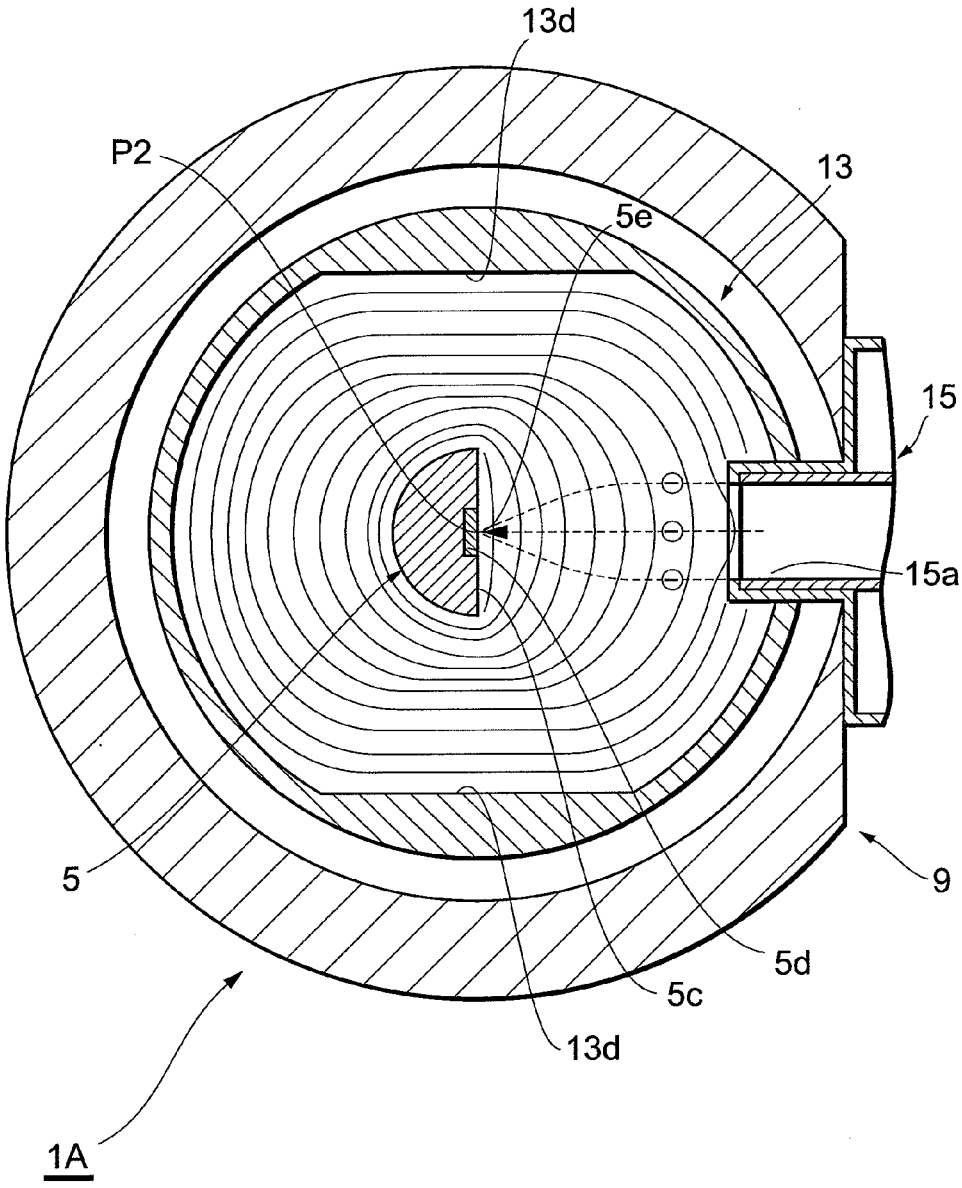
FIG. 6 is a sectional view of an internal structure of the X-ray tube according to the first embodiment taken on line VI-VI in FIG. 5.
Figure 7:
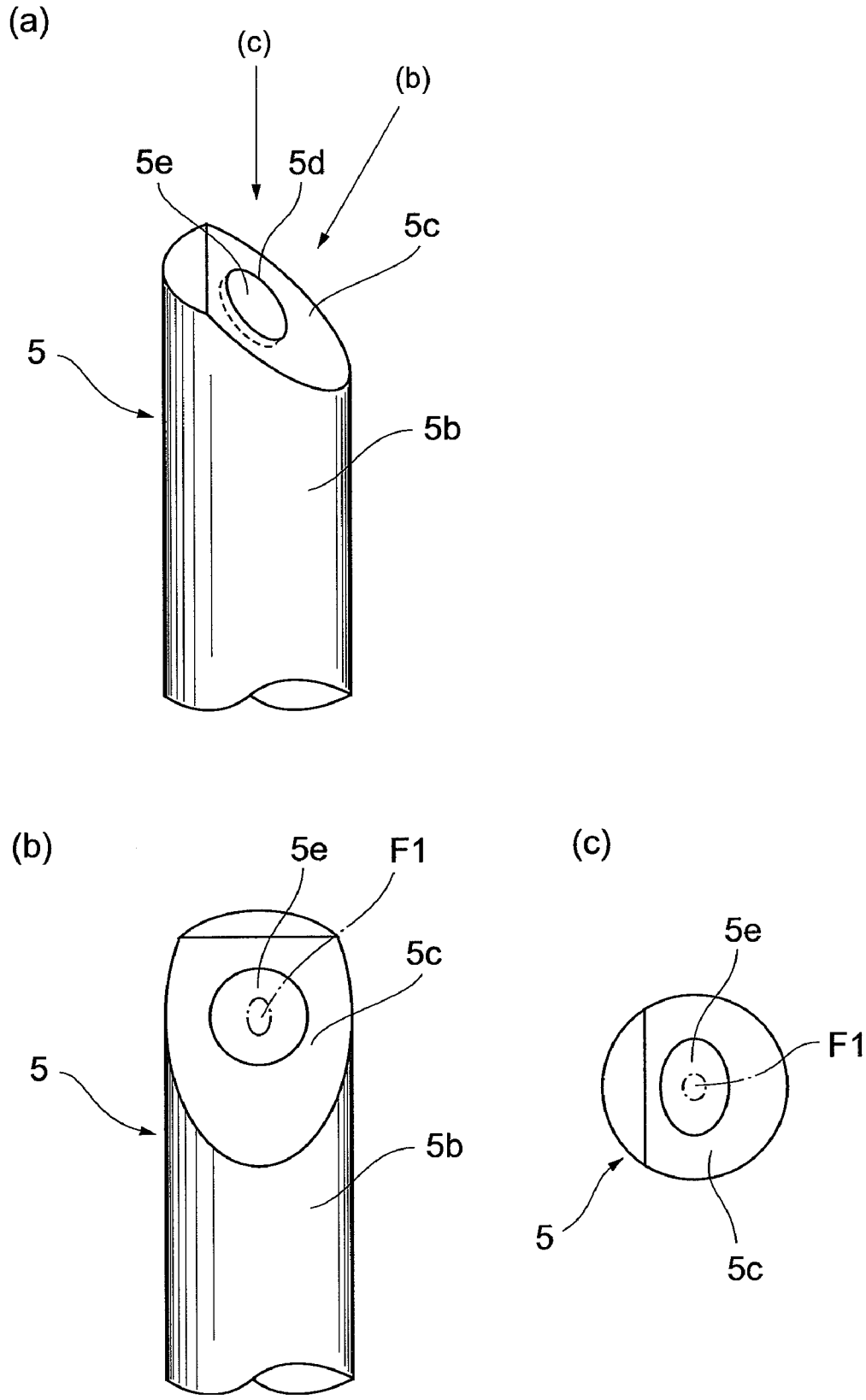
FIG. 7 shows enlarged perspective views of an arrangement of a tip of the anode.
Figure 8:
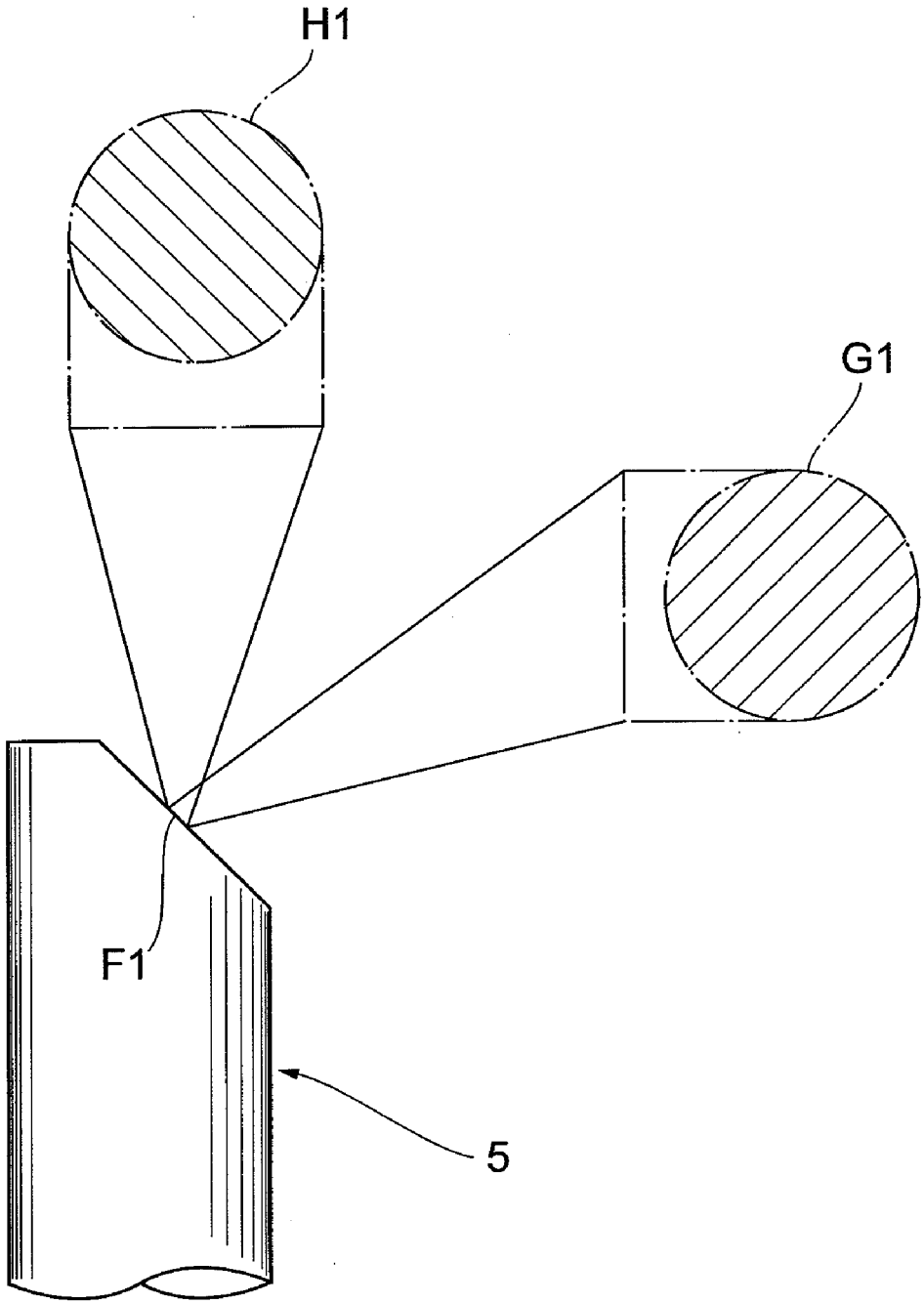
FIG. 8 is a diagram for describing an electron incidence shape and an X-ray generation shape at the tip of the anode.

FIG. 5 is an enlarged sectional view for describing equipotential surfaces formed in a periphery of a protruding portion of an anode in the X-ray tube 1A according to the first embodiment. FIG. 6 is a sectional view of an internal structure of the X-ray tube 1A according to the first embodiment taken on line VI-VI in FIG. 5. FIG. 7 shows enlarged perspective views of an arrangement of a tip of the anode. FIG. 8 is a diagram for describing an electron incidence shape and an X-ray generation shape at the tip of the anode. Specifically, in FIG. 7, the area (a) is a perspective view of the tip of the anode, the area (b) is a perspective view of the tip of the anode as viewed in a direction of arrow (b) in the area (a), and the area (c) is a perspective view of the tip of the anode as viewed in a direction of arrow (c) in the area (a).

As shown in FIGS. 1 to 4, the X-ray tube 1A according to the first embodiment is a sealed X-ray tube. The X-ray tube 1A has a tubular vacuum enclosure main body 3 as an anode housing unit, and the anode 5, having a target 5*d* to be described below, is housed in the vacuum enclosure main body 3. The vacuum enclosure main body 3 includes a substantially cylindrical bulb 7, supporting the anode 5, a substantially cylindrical head 9, having an X-ray emission window 10, and a ring member 7*b*, connecting the bulb 7 and the head 9, and a vacuum enclosure 2 is formed by welding an electron gun housing unit 11 to the vacuum enclosure main body 3. An interior of the vacuum enclosure 2 is decompressed to a predetermined degree of vacuum. The bulb 7 and the head 9 are fixed to the ring member 7*b* so as to have a tube axis line C1 in common. The X-ray emission window 10 is disposed at one end of the head 9 in the tube axis line C1 direction. On the other hand, the other end in the tube axis line C1 direction of the bulb 7, comprised of glass (insulator), has a shape that decreases in diameter in a form of closing an opening and holds the anode 5 at a desired position inside the vacuum enclosure main body 3 with a part of a base end 5*a* of the anode 5 being exposed to an exterior. The vacuum enclosure main body 3 thus has the X-ray emission window 10 at one end thereof and holds the anode 5 at the other end thereof. In the description that follows, upper and lower sides are defined so that one end side (the X-ray emission window 10 side) in the tube axis line C1 direction of the vacuum enclosure main body 3 is the "upper" side, and the other end side (the side at which the anode 5 is held) in the tube axis line C1 direction of the vacuum enclosure main body 3 is the "lower" side.

The ring member 7*b* is fused to an upper end of the bulb 7. The ring member 7*b* is a cylindrical member comprised of metal and has an annular flange formed at its upper end. The upper end of the ring member 7*b* is welded to a lower end of the head 9 in a state of being put in contact with the lower end.

The head 9 is metal member with a substantially cylindrical shape, and an annular flange 9*a* is formed on its outer periphery. The head 9 is divided into a lower portion 9*b* and an upper portion 9*c* across the flange portion 9*a*, and the ring member 7*b* is welded to a lower end of the lower portion 9*b* so that the tube axis line C1 is shared in common with the bulb 7. The X-ray emission window 10 comprised of a Be material is disposed at the upper portion 9*c* of the head 9 so as to close an opening of an end of the upper portion 9*c*. Furthermore, an exhaust port 9*e* for putting an interior of the vacuum enclosure 2 into a vacuum state is formed in the upper portion 9*c*, and an exhaust tube is fixed to an inner wall of the head 9 in which the exhaust port 9*e* is formed.

An inner tube (inner container) 13 of substantially cylindrical shape is mounted inside the head 9. A lower end 13*a* in a tube axis direction of the inner tube 13 is set inside a space inside the bulb 7 and at an outer peripheral side thereof is disposed a contacting portion 13*b* that contacts the lower end of the head 9.

A flat portion 9*d* is formed on an outer periphery of the upper portion 9*c* of the head 9 (see FIGS. 1 and 2), and a head side through hole 9*f*, for installation of the electron gun housing unit 11, is formed in the flat portion 9*d*. On the other nahd, an inner tube side through hole 13*f*, which is smaller in diameter than the head side through hole 9*f*, is formed for installation of the electron gun housing unit 11 in the inner tube 13, disposed inside the head portion 9. As viewed from the large-diameter head side through hole 9*f* side, the small-diameter inner tube side through hole 13*f* is positioned inside the large-diameter head side through hole 9*f* at a position decentered toward the X-ray emission window 10 side (see FIG. 4).

The electron gun housing unit 11 has a substantially cylindrical shape and at one end thereof is disposed a cylindrical neck 11*a*, which protrudes and is reduced in diameter, and a cylindrical portion 11*b* protrudes from the neck 11*a*. By the neck 11*a* being fitted into the head side through hole 9*f* of the head 9 and the cylindrical portion 11*b* being fitted into the inner tube side through hole 13*f* of the inner tube 13, the electron gun housing unit 11 and the inner tube 13 are positioned in the head 9 in a manner such that a tube axis line C3 of the electron gun housing unit 11 is substantially orthogonal to the tube axis line C1 of the vacuum enclosure main body 3. The electron gun housing unit 11 is joined to the head 9. An electron gun 15 is housed inside the electron gun housing unit 11, and the electron gun 15 is mounted onto the head 9 via the electron gun housing unit 11.

As shown in FIG. 3, the electron gun 15 includes an electron generating unit 23 and a focusing electrode 25. The focusing electrode 25 is cylindrical, and a tip of the focusing electrode 25 is fitted in an inner peripheral surface of the cylindrical portion 11*b* of the electron gun housing unit 11. By this configuration, the focusing electrode 25 is positioned in the electron gun housing unit 11. An opening at the tip of the focusing electrode 25 and an opening of the cylindrical portion 11*b* are formed to be circular, and the opening at the tip of the focusing electrode 25 functions as an electron emission exit 15*a*.

When electrons are emitted from the electron generating unit 23, the electrons are subject to a focusing action by the focusing electrode 25. The electrons are then made incident on the target 5*d* (X-ray target), to be described below, via the electron emission exit 15*a*.

The bulb 7, the head 9, and the inner tube 13 are positioned concentrically and have the tube axis line C1 in common. The anode 5 has a cylindrical main body 5*f* that extends directly upward along the tube axis line C1 and has an axis line C2 that is collinear to the tube axis line C1. The main body 5*f* is comprised of copper, and a base end of the main body 5*f* is joined to another end 7*a* of the bulb 7. An inclined surface 5*c* is formed at a tip 5*b* of the anode 5. The inclined surface 5*c* is inclined to an orientation of facing the electron gun 15 and by a predetermined angle with respect to the axis line C2 of the main body 5*f* to enable X-rays to be taken out from the X-ray emission window 10 positioned along the tube axis line C1. In the inclined surface 5*c*, the disk-like target 5*d* is embedded so that an electron incidence surface 5*e* thereof is parallel to the inclined surface 5*c* (see FIG. 7). The target 5*d* is comprised of tungsten, and besides the target 5*d*, the anode 5 is comprised of copper. Electrons emitted from the electron emission exit 15*a* of the electron gun 15 are made incident on the electron incidence surface 5*e* and X-rays are generated from the target 5*d*.

The tip 5*b* of the anode 5 is housed in the inner tube 13. The inner tube 13 is comprised of a conductive metal. As shown in FIGS. 1, 4, 5, and 6, the inner tube 13 is disposed inside the head 9 so as to have the tube axis line C1 in common with the bulb 7 and the head 9. A lower end side of the inner tube 13 in the tube axis C1 direction is disposed at the base end 5*a* side of the anode 5 and is inserted in the space inside the bulb 7. A pair of conductive flat portions 13*d*, having the same inwardly bulging shape, are formed on an inner wall surface of the inner tube 13. The pair of conductive flat portions 13*d* are symmetrical in regard to the tube axis line C1 and the tube axis line C3 of the electron gun housing unit 11. The pair of conductive flat portions 13*d* are disposed so as to oppose each other while sandwiching the electron incidence surface 5*e* of the target 5*d*, disposed inside the inner tube 13. In particular, the pair of conductive flat portions 13*d* are disposed parallel to a reference plane, which is a plane orthogonal to the electron incidence surface 5*e* of the target 5*d* and contains a first reference line, passing through a center of the electron emission exit 15*a* and a center of the electron incidence surface 5*e*, and a second reference line, which is a straight line intersecting the first reference line on the electron incidence surface 5*e* and joins the center of the electron incidence surface 5*e* and a center of the X-ray emission window 10. The pair of conductive flat portions 13*d* must have lengths that at least cover regions corresponding to the inclined surface 5*c*.

The electrons emitted from the electron gun 15 propagate while receiving a force in directions of normals to the equipotential surfaces formed in the space inside the head 9 by application of a voltage to respective electrodes inside the head 9. In a final stage, by incidence of the emitted electrons onto the electron incidence surface 5*e* of the target 5*d*, X-rays are generated. A position of the electron incidence surface 5*e* at which the X-rays are made incident is a focal point position of the X-rays, an FOD is a distance from the focal point position of the X-rays to the X-ray emission window 10, and a magnification factor of a magnified transmission image can be improved more the shorter the FOD.

A description shall now be provided in regard to a size of a focal point of electrons, a focal point shape, and the FOD in the X-ray tube 1A according to the first embodiment by providing a comparison with a conventional X-ray tube (X-ray tube described in Patent Document 1) arrangement, from which the hood electrode has been removed.

Figure 16:
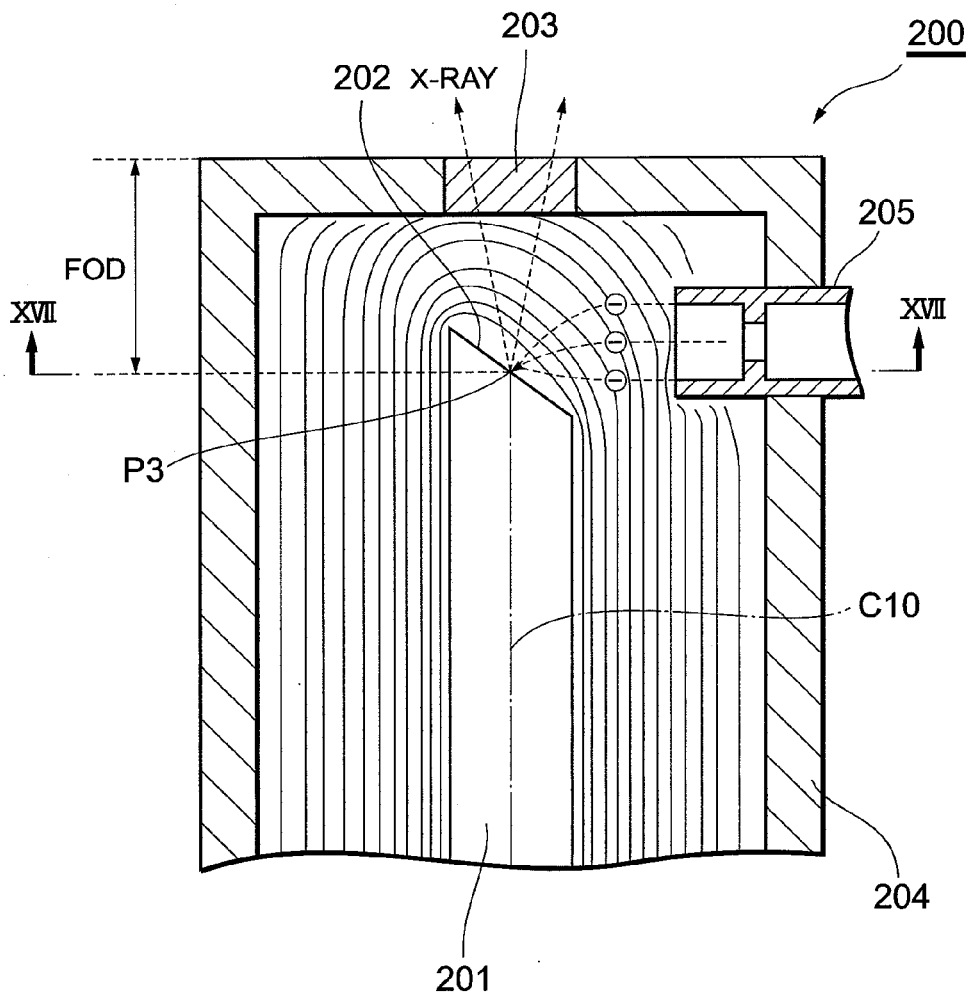
FIG. 16 is an enlarged sectional view of a structure of a vicinity of a target in a conventional X-ray tube.
Figure 17:
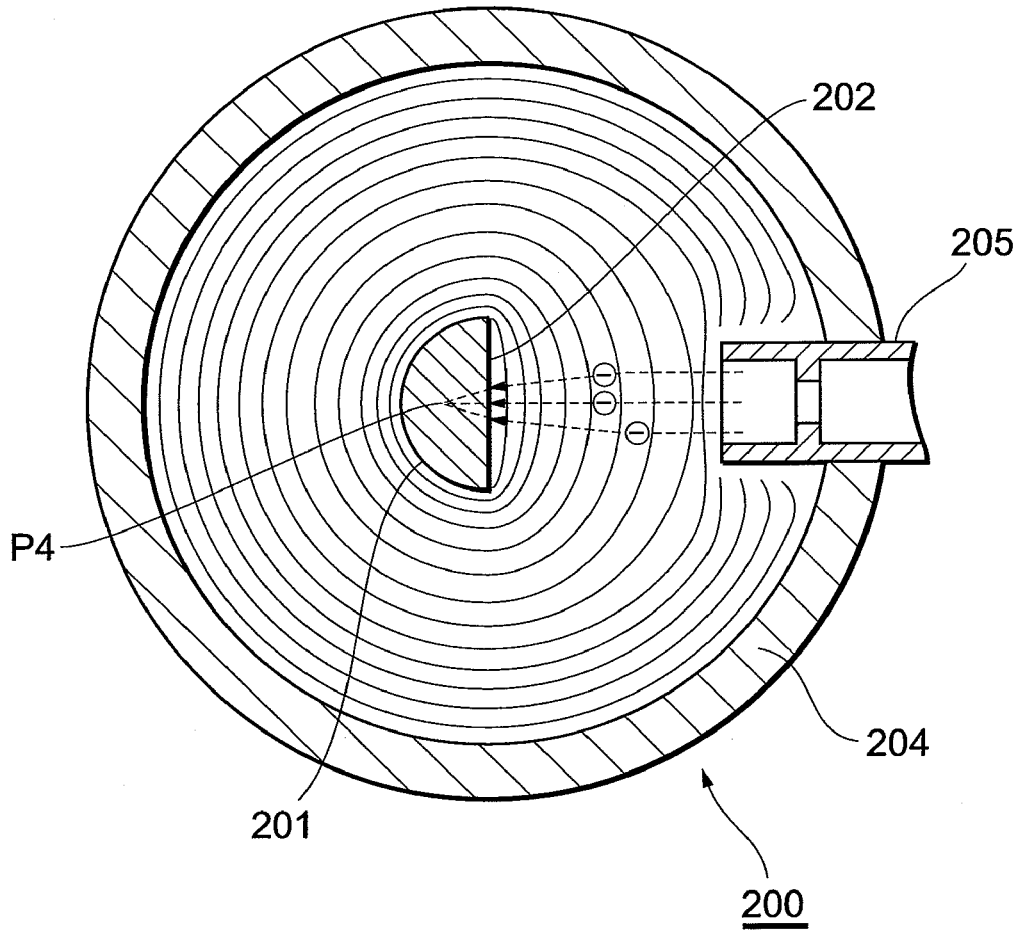
FIG. 17 is a sectional view of an internal structure of the conventional X-ray tube taken on line XVII-XVII in FIG. 16.
Figure 18:
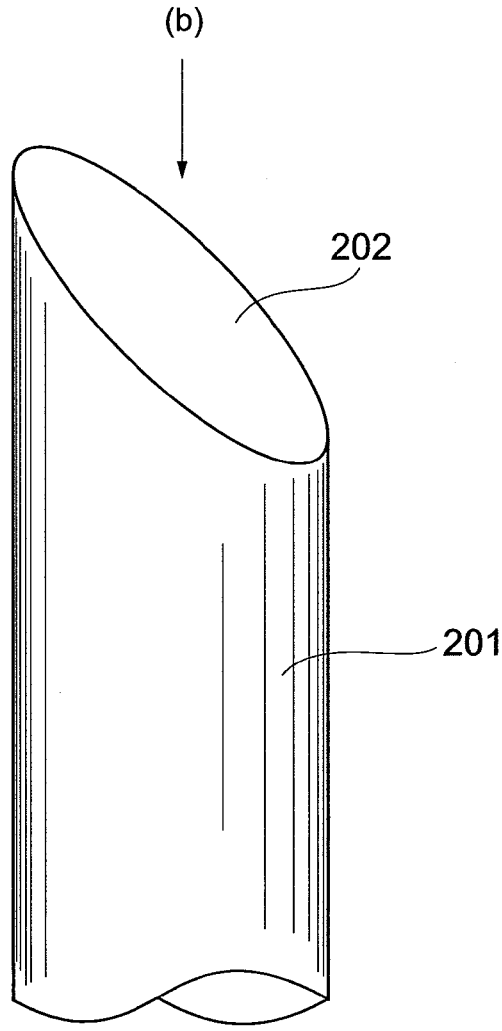
FIG. 18 is an enlarged perspective view of an arrangement of a target tip in the conventional X-ray tube.
Figure 18:
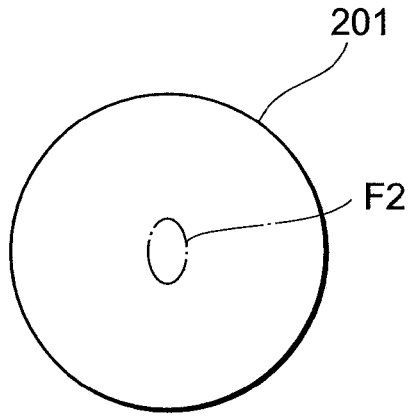
Figure 19:
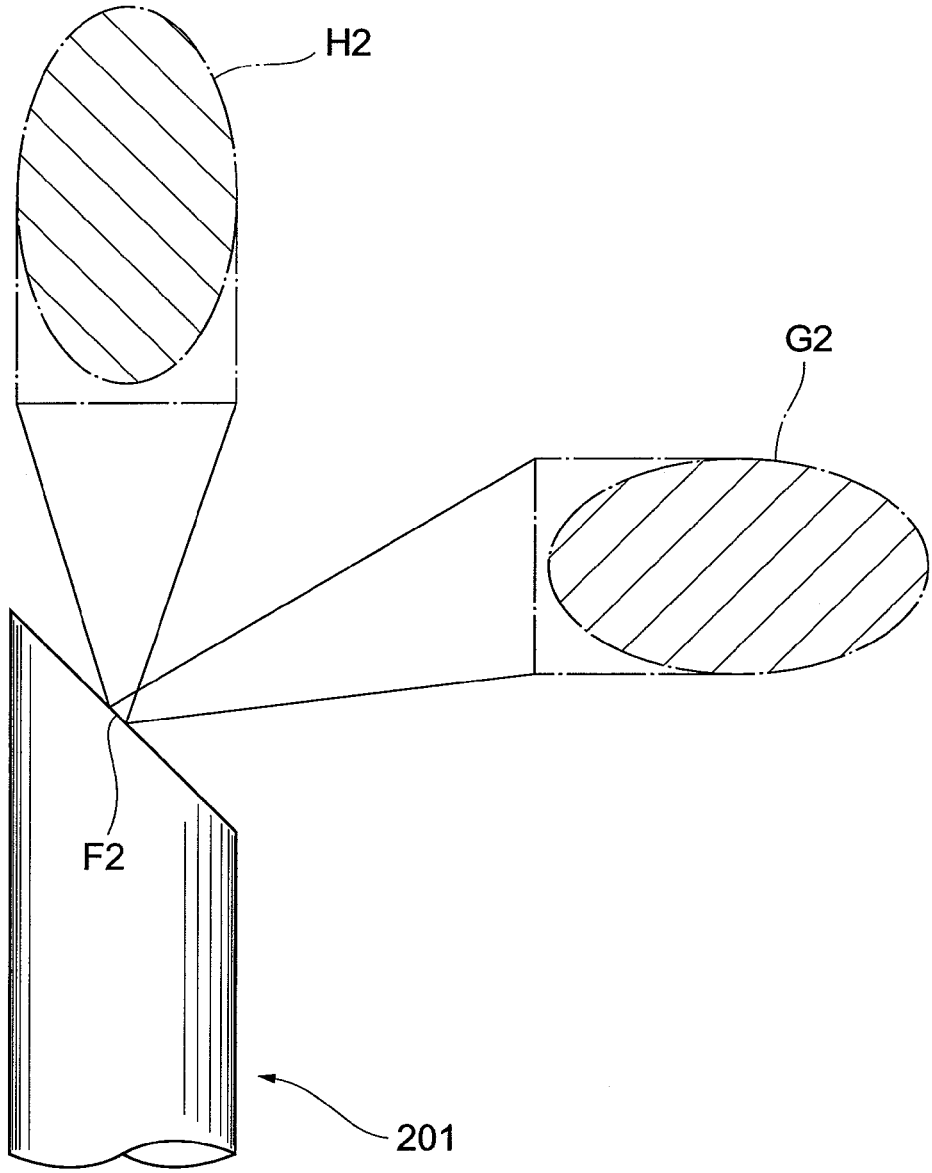
FIG. 19 is a diagram for describing an electron incidence shape and an X-ray generation shape at an anode tip in the conventional X-ray tube.

FIGS. 16 to 19 to show an X-ray tube (hereinafter referred to as the "conventional X-ray tube") 200, with which the hood electrode is removed from the conventional X-ray tube. FIG. 16 is an enlarged sectional view of a structure in a vicinity of a target in the conventional X-ray tube 200. FIG. 17 is a sectional view of an internal structure of the conventional X-ray tube 200 taken on line XVII-XVII in FIG. 16. FIG. 18 shows enlarged perspective views of an arrangement of a target tip in the conventional X-ray tube 200. FIG. 19 is a diagram for describing an electron incidence shape and an X-ray generation shape at an anode tip in the conventional X-ray tube 200. In FIG. 18, the area (a) is a perspective view of the target tip, and the area (b) is a perspective view of the target tip as viewed in a direction indicated by arrow (b) in the area (a).

In the conventional X-ray tube 200, a cylindrical anode 201 is disposed along a tube axis line C10 of a cylindrical case 204. An obliquely notched inclined surface 202 is formed at a tip of the anode 201, and the inclined surface 202 is the target. X-rays are generated by incidence of electrons onto the inclined surface 202.

Here, generally, the closer an electron incidence shape G2 is to being circular, the closer an X-ray generation shape H2 is to being circular as a result. The "electron incidence shape" refers to a cross-sectional shape of an electron beam before incidence of the electrons onto the target, and an "X-ray generation shape" refers to a cross-sectional shape of X-rays when viewed from an X-ray emission window 203. That is, the closer a focal point position P3 (FIG. 16) of the electron beam along an extension of a propagation path of the electrons emitted from an electron gun 205 and a focal point position P4 (FIG. 17) of the electron beam along an extension of a propagation path of the electrons emitted from an electron gun 205 become so as to substantially match each other (and especially in a case where microfocusing is sought, the closer these positions become so as to substantially match on the target), the closer the electron incidence shape G2 becomes to being circular and the closer the X-ray generation shape H2 becomes to being circular.

In the conventional X-ray tube 200, because the electron beam focal point positions P3 and P4 differ (see FIGS. 16 and 17), the electron incidence shape G2 is elliptical as shown in FIG. 19. As a result, the X-ray generation shape H2 also readily tends to be elliptical.

On the other hand, as shown in FIGS. 5 and 6, in the X-ray tube 1A according to the first embodiment, the pair of conductive flat portions 13*d*, positioned so as to oppose each other while sandwiching the electron incidence surface 5*e* of the target 5*d*, are disposed in the inner tube 13. Thus unlike the conventional X-ray tube 200 an electron beam focal point position P1 (see FIG. 5) and an electron beam focal point position P2 (see FIG. 6) can be made substantially equal to the X-ray tube 1A according to the first embodiment, and thus as shown in FIG. 8, an electron incidence shape G1 is made closer to being circular. As a result, an X-ray generation shape H1 also tends to be circular readily.

Also, in the conventional X-ray tube 200, as a result of the electron incidence shape G2 being elliptical, an electron incidence region shape F2 on the target becomes a shape that is close to being elliptical as viewed from the X-ray emission window 203 (see FIG. 16) as indicated by an alternate long and short dashes line in the area (b) of FIG. 18. As a result, the X-ray generation shape H2 is also elliptical and the magnified transmission image becomes unclear.

On the other hand, in the X-ray tube 1A according to the first embodiment, because the electron incidence shape G1 is made closer to being circular, an electron incidence region shape F1 on the target can readily be made circular as viewed from the X-ray emission window 10 (see FIG. 5) as indicated in FIG. 7C. By the X-ray generation shape H1 thus being circular, a clear magnified transmission image can be obtained.

Also, as shown in FIGS. 1 and 2, in the X-ray tube 1A according to the first embodiment, by the inner tube 13 being mounted inside the head 9, the conductive planar portions 13*d* can be formed readily as compared with a case where the head 9 and the inner tube 13 are formed integrally.

Also, in the X-ray tube 1A according to the first embodiment, the electron emission exit 15*a* (see FIG. 4), disposed in the electron gun 15, is formed to be circular. The electron incidence shape can thus readily be made even more circular.

Second Embodiment

Figure 9:
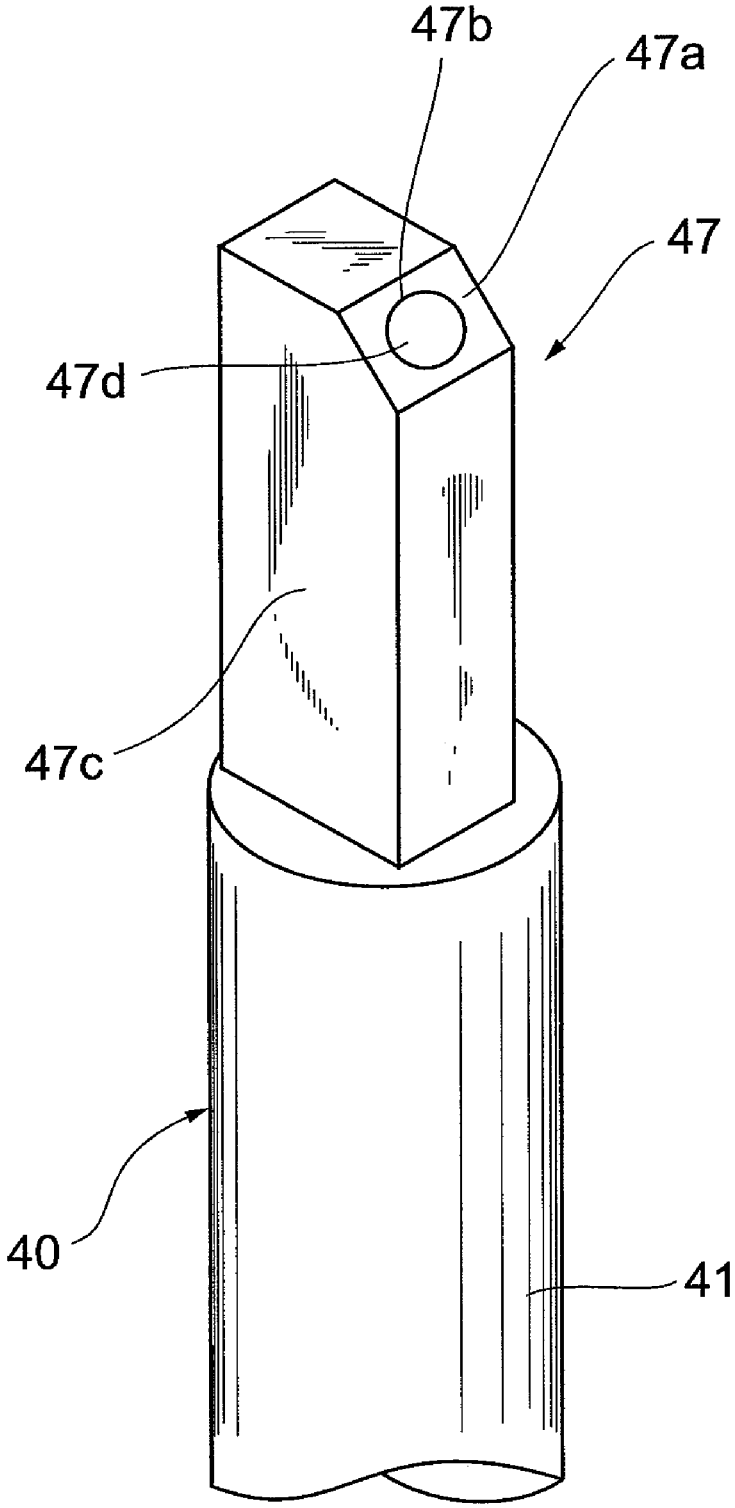
FIG. 9 is an enlarged perspective view, particularly of an arrangement of a protruding portion of an anode as a characteristic portion of a second embodiment of an X-ray tube according to the present invention.
Figure 10:
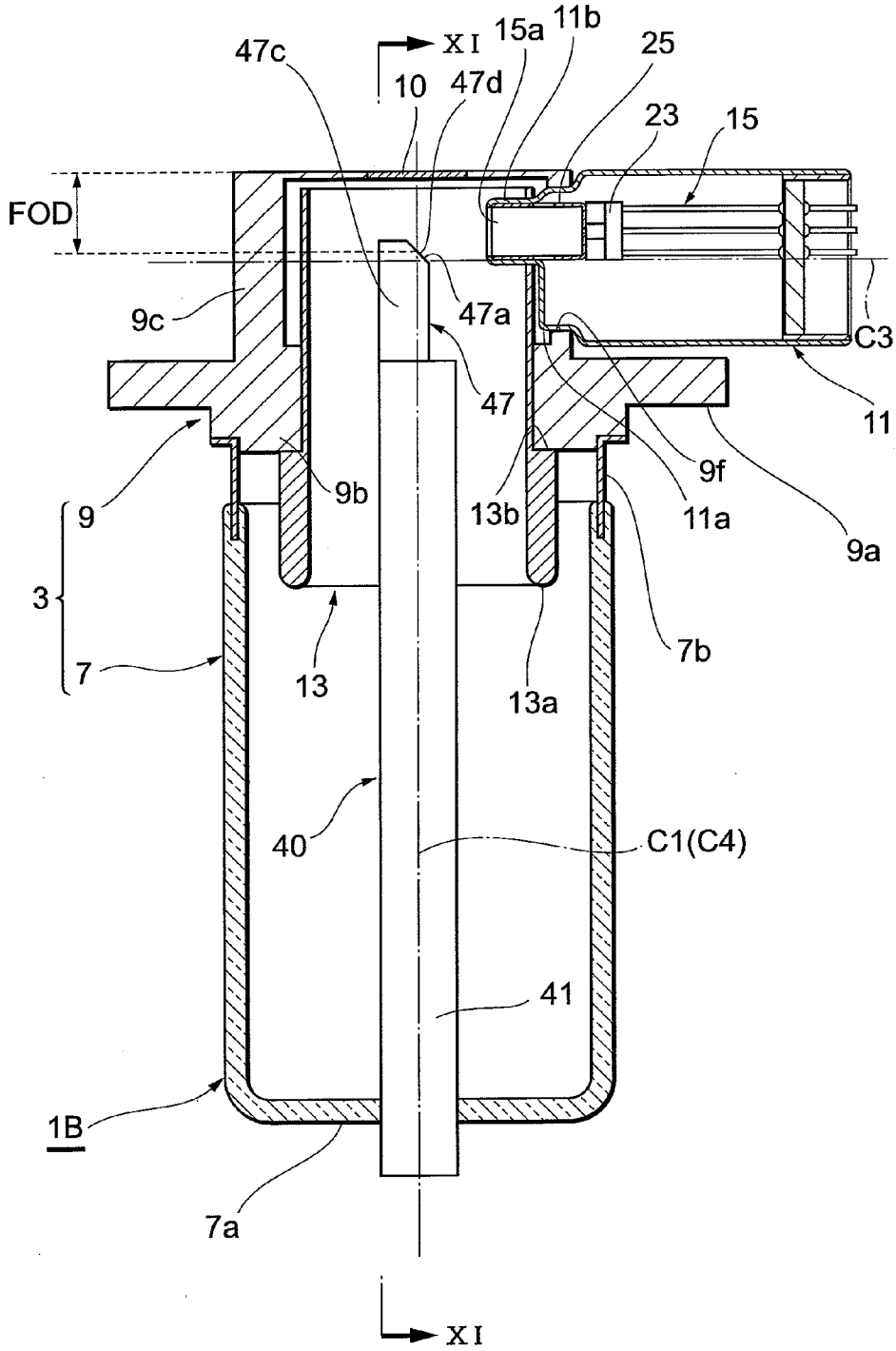
FIG. 10 is a sectional view of an internal structure of the entirety of the X-ray tube according to the second embodiment and practically corresponds to a section taken on line III-III in FIG. 2.
Figure 11:
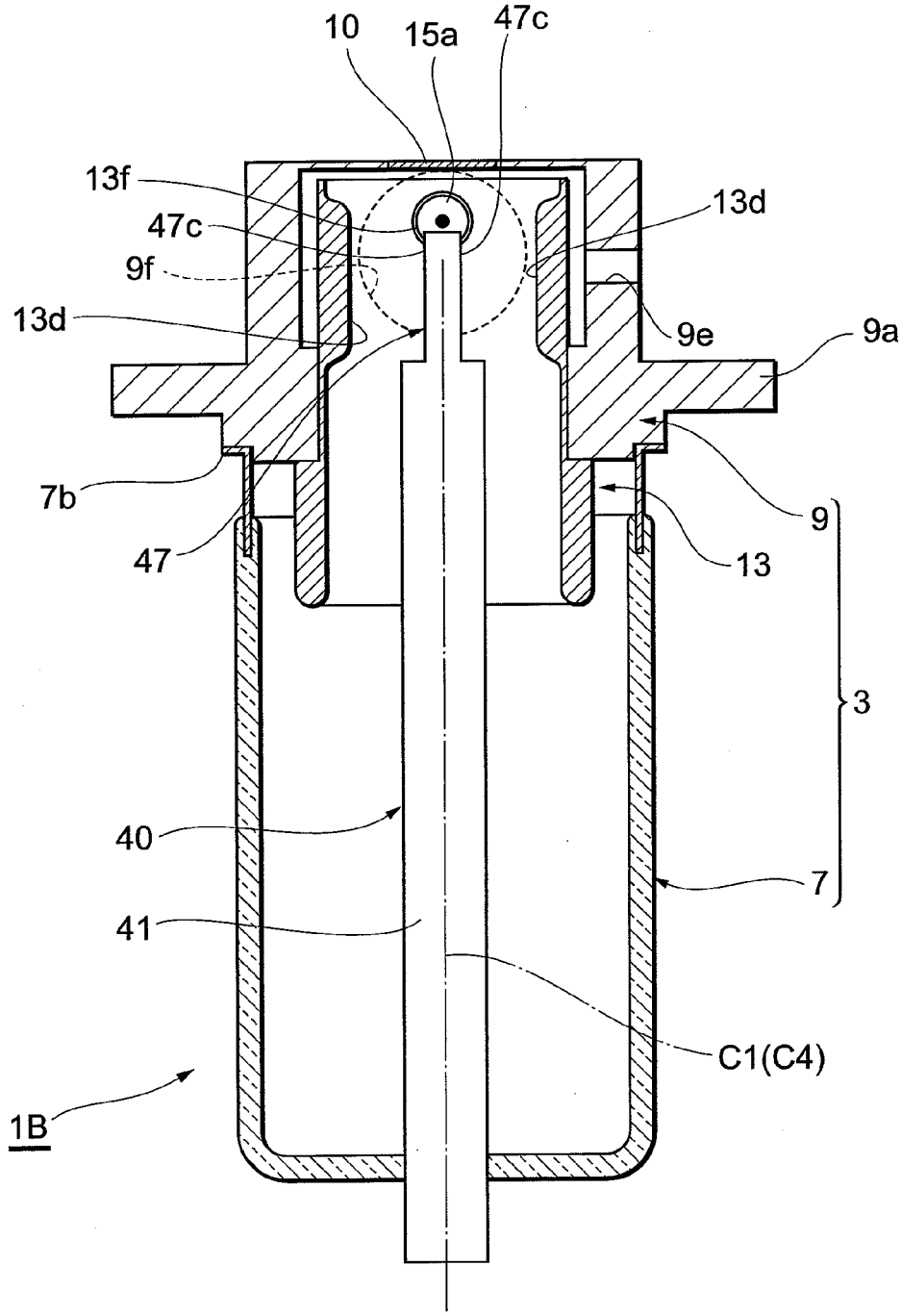
FIG. 11 is a sectional view of an internal structure of the X-ray tube according to the second embodiment taken on line XI-XI in FIG. 10.
Figure 12:
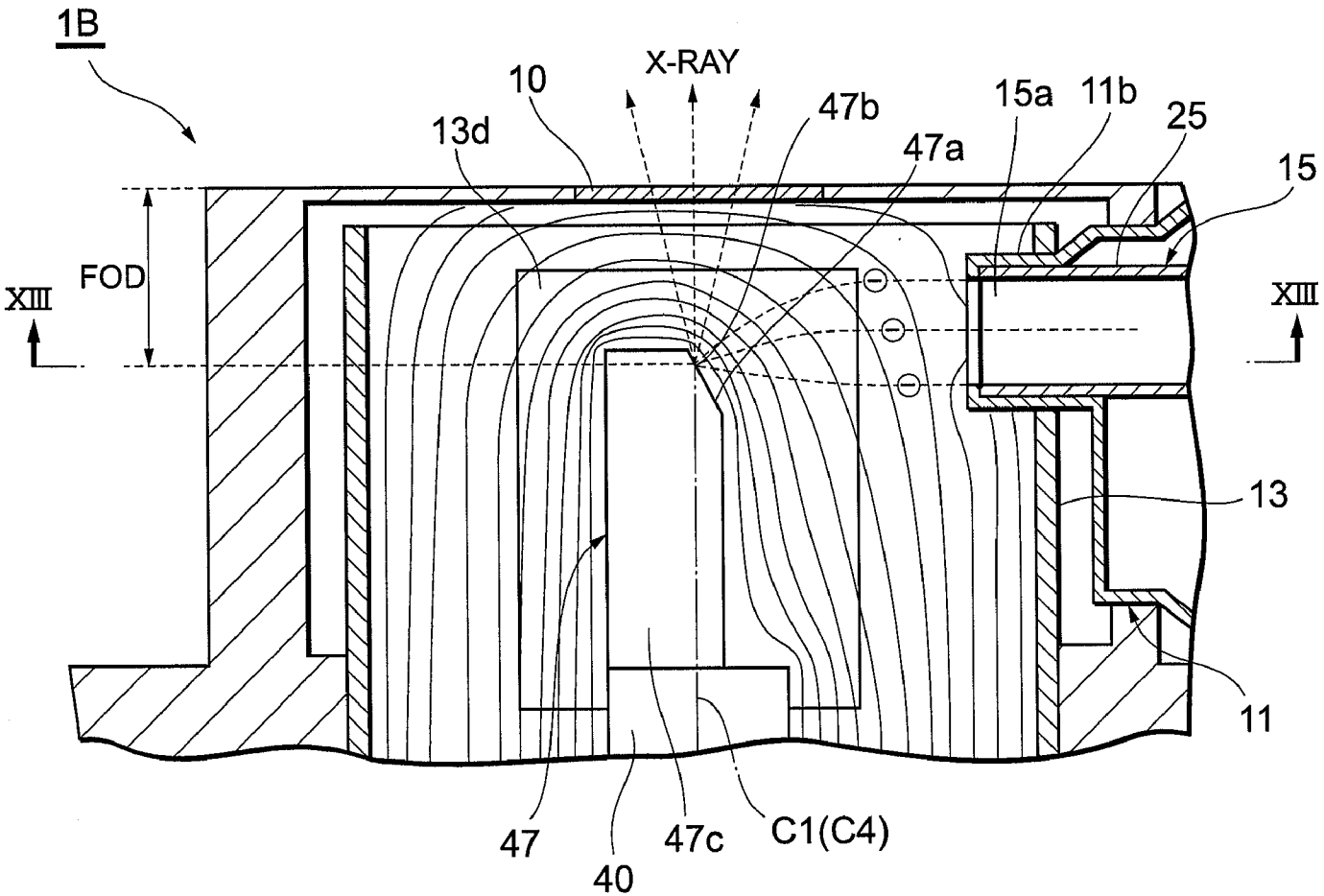
FIG. 12 is an enlarged view of a vicinity of a protruding portion in the X-ray tube according to the second embodiment and is a diagram for describing equipotential surfaces formed in a periphery of a target of the protruding portion.
Figure 13:
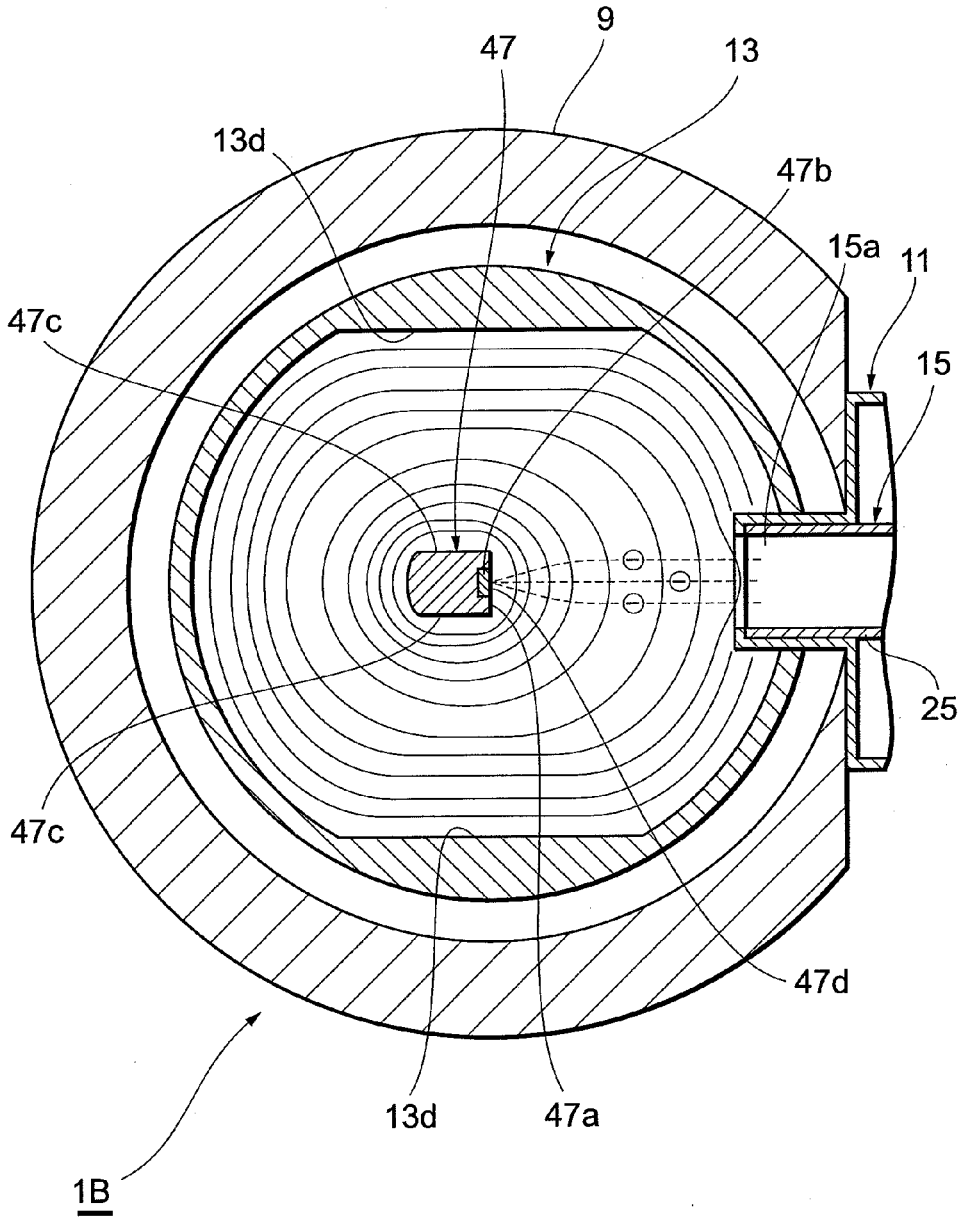
FIG. 13 is a sectional view of an internal structure of the X-ray tube according to the second embodiment taken on line XIII-XIII in FIG. 12.

Next, an X-ray tube 1B according to a second embodiment will be explained with reference to FIGS. 9 to 13. FIG. 9 is an enlarged perspective view, particularly of an arrangement of a protruding portion of an anode as a characteristic portion of the second embodiment of the X-ray tube according to the present invention. FIG. 10 is a sectional view of an internal structure of the entirety of the X-ray tube 1B according to the second embodiment and practically corresponds to a section taken on line III-III in FIG. 2. FIG. 11 is a sectional view of an internal structure of the X-ray tube 1B according to the second embodiment taken on line XI-XI in FIG. 10. FIG. 12 is an enlarged view of a vicinity of a protruding portion in the X-ray tube 1B according to the second embodiment and is a diagram for describing equipotential surfaces formed in a periphery of a target of the protruding portion. FIG. 13 is a sectional view of an internal structure of the X-ray tube 1B according to the second embodiment taken on line XIII-XIII in FIG. 12. In the X-ray tube 1B according to the second embodiment, structures that are the same as or equivalent to those of the X-ray tube 1A according to the first embodiment shall be provided with the same symbols and description thereof shall be omitted.

As shown in FIGS. 9 to 11, in the second embodiment, an anode 40 has a straightly-extending, cylindrical shape. The anode 40 has a main body 41, having an axis line C4 collinear to the tube axis line C1 of the vacuum enclosure main body 3, and a protruding portion 47, extending along the axis line C4, is formed at a tip of the main body 41. The protruding portion 47 has a substantially rectangular cross-sectional shape and is disposed inside the head 9, and an inclined surface 47*a* is formed at a tip of the protruding portion 47. The inclined surface 47*a* is inclined to an orientation of facing the electron gun 15 and by just a predetermined angle with respect to the axis line C4 of the main body 41 to enable X-rays to be taken out from the X-ray emission window 10. In the inclined surface 47*a*, a disk-like target 47*b* is embedded, and an electron incidence surface 47*d* of the target 47*b* is parallel to the inclined surface 47*a*. The target 47*b* is comprised of tungsten, and besides the target 47*b*, the anode 40 is comprised of copper.

On the protruding portion 47 of the anode 40 are formed a pair of side surfaces 47*c*, extending in the same direction as the axis line C4 of the main body 41 and disposed parallel so as to sandwich the electron incidence surface 47*d*. Furthermore, a width (distance) between the pair of side surfaces 47*c* is made smaller than a width (diameter) of the main body 41 in the same direction as the width. An electron beam focus position shown in FIG. 12 and an electron beam focus position shown in FIG. 13 can thus be matched substantially, and the X-ray generation shape H1 tends to be circular readily. Also, as shown in FIGS. 10 and 11, in the X-ray tube 1B according to the second embodiment, by making the main body 41 of the anode 40 have a straight shape and making the protruding portion 47 extend along the axis line C4 of the main body 41 from the tip of the main body 41, discharge is less likely to occur and a high operation stability can be achieved as compared with an anode having a bent shape.

Third Embodiment

Figure 14:
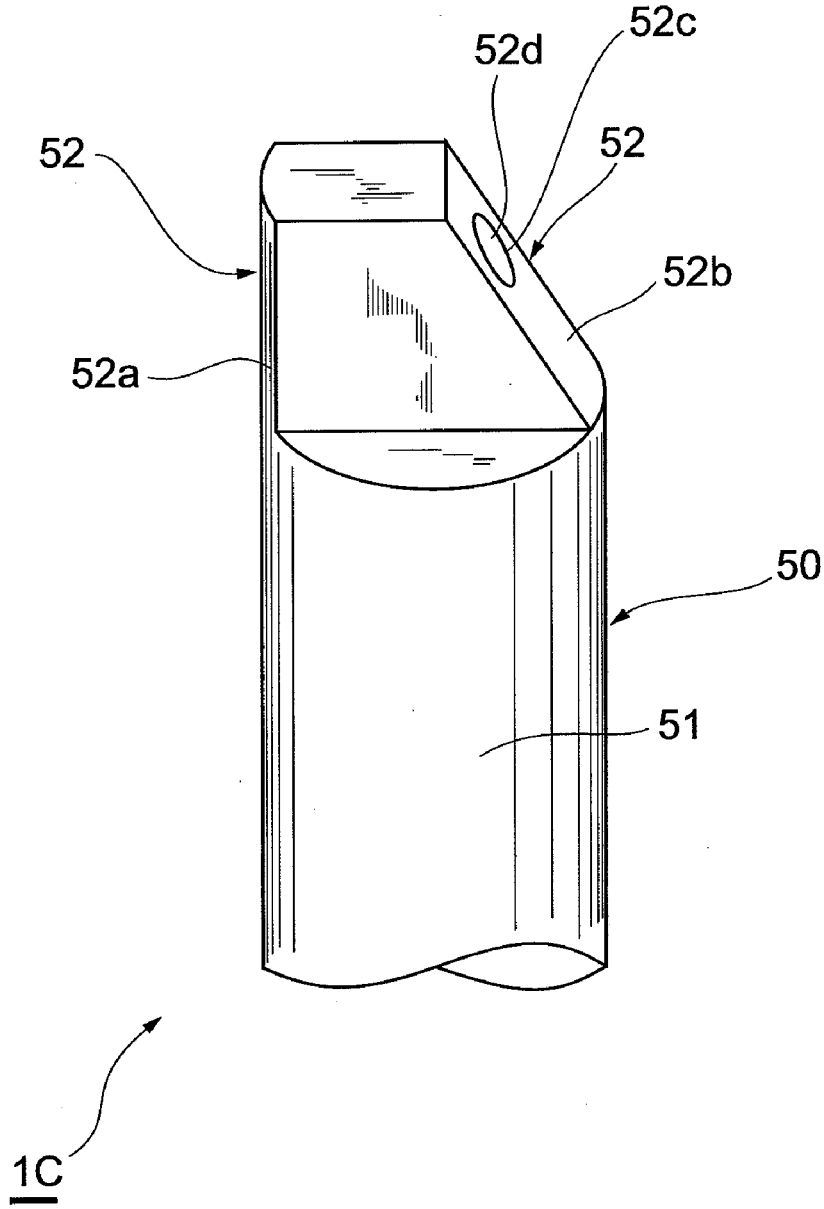
FIG. 14 is an enlarged perspective view, particularly of an arrangement of a protruding portion of an anode as a characteristic portion of a third embodiment of an X-ray tube according to the present invention.
Figure 15:
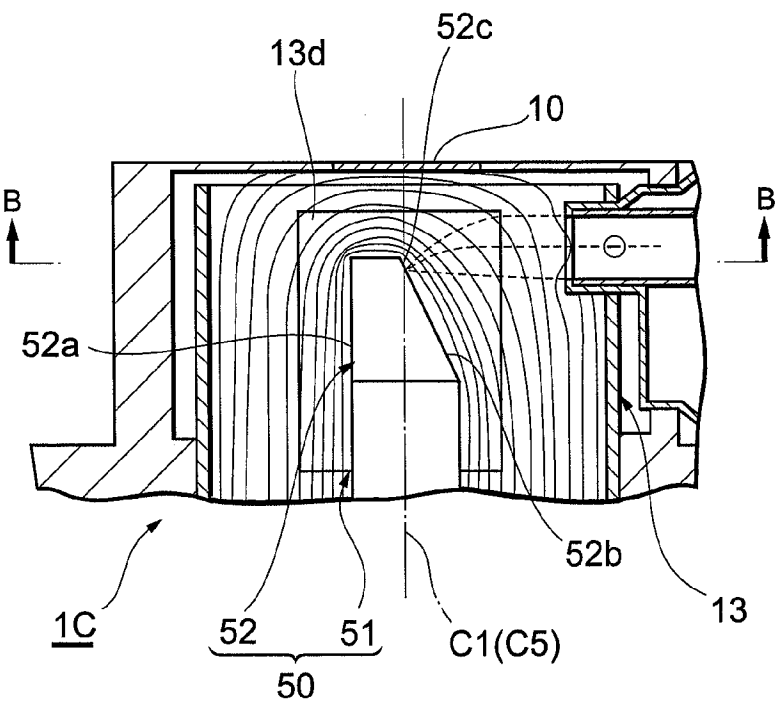
FIG. 15 shows diagrams for describing equipotential surfaces formed in a periphery of a target of the protruding portion for the third embodiment of the X-ray tube according to the present invention.
Figure 15:
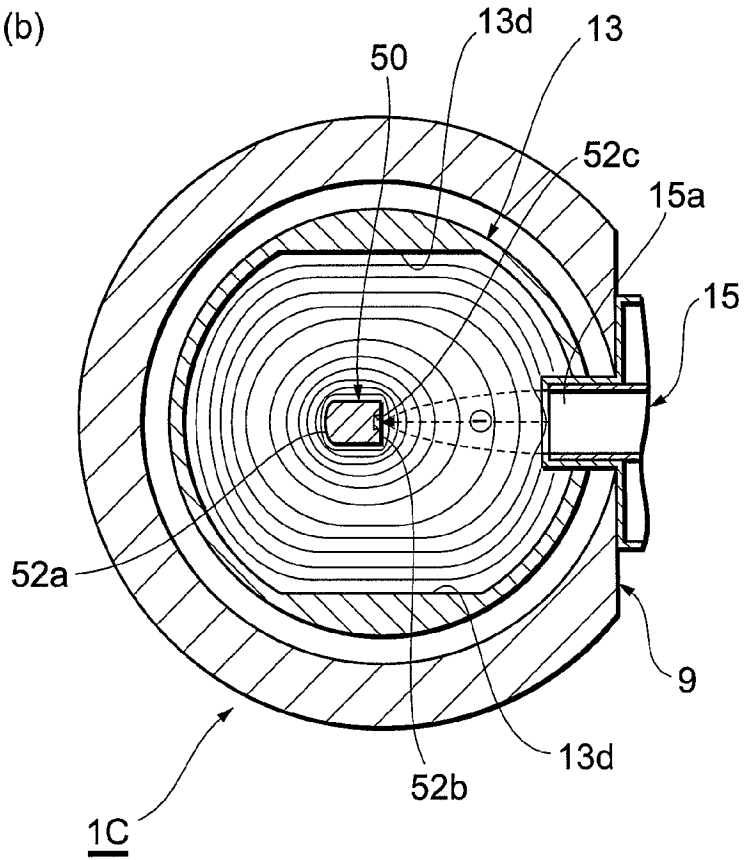

Next, an X-ray tube 1C according to a third embodiment will be explained with reference to FIGS. 14 and 15. FIG. 14 is an enlarged perspective view, particularly of an arrangement of a protruding portion of an anode as a characteristic portion of the third embodiment of the X-ray tube according to the present invention. FIG. 15 shows diagrams for describing equipotential surfaces formed in a periphery of a target of the protruding portion for the third embodiment of the X-ray tube according to the present invention. Specifically, in FIG. 15, the area (a) is an enlarged sectional view of a vicinity of the protruding portion, and the area (b) is a sectional view of a vicinity of the protruding portion taken on line B-B on the area (a). In the X-ray tube 1C according to the third embodiment, structures that are the same as or equivalent to those of the X-ray tube 1A according to the first embodiment shall be provided with the same symbols and description thereof shall be omitted.

In the X-ray tube 1C according to the third embodiment, an anode 50 has a straightly-extending, cylindrical shape. The anode 50 has a main body 51, having an axis line C5 collinear to the tube axis line C1 of the vacuum enclosure main body 3, and a protruding portion 52, extending along the direction of the axis line C5 of the main body 51, is disposed at a tip of the main body 51. The protruding portion 52 has a curved surface 52*a*, formed flush to a surface of the main body 51 and extending straightly along the axis line C5. At the protruding portion 52, an inclined surface 52*b*, continuous with the surface of the main body 51, is formed at an opposite side of the curved surface 52*a* across the axis line C5 of the main body 51. The inclined surface 52*b* is inclined by just a predetermined angle with respect to the axis line C5 of the main body 51 so that X-rays are taken out from the X-ray emission window 10 positioned along the axis line C5 (see the area (a) of FIG. 15). A target 52*c* comprised of tungsten is disposed on the inclined surface 52*b* (see FIG. 14). The protruding portion 52 of the anode 50 is housed in the inner tube 13, and the pair of conductive flat portions 13*d*, disposed so as to oppose each other while sandwiching the electron incidence surface 52*d* of the target 52*c*, are formed in the inner tube 13. With the exception of the anode 50, the X-ray tube 1C according to the third embodiment is constituted of a structure equivalent to that of the X-ray tube 1A according to the first embodiment.

In similar to the X-ray tubes 1A and 1B according to the first and second embodiments, the X-ray generation shape H1 tends to be circular readily in the X-ray tube 1C according to the third embodiment unlike in the conventional X-ray tube 200 (see FIGS. 16 to 18).

Also as shown in FIG. 14, the protruding portion 52 of the anode 50 has the curved surface 52*a* that is flush to the surface of the main body 51. Thus, as compared with a case where there are no surfaces at all that are flush, discharge is less likely to occur and a high operation stability can be achieved.

The present invention is not restricted to the above-described embodiments. For example, the material of the targets 5*d*, 47*b*, and 52*c* is not restricted to tungsten and may be any other X-ray generating material. The targets 5*d*, 47*b*, and 52*c* are not restricted to being disposed at portions of the anodes 5, 40, and 50, and the entireties of the anodes 5, 40, and 50 may be formed integrally from a desired X-ray generating material so that the anodes 5, 40, and 50 become the targets in themselves. "Housing" in the case of housing the anode 5, 40, or 50 in the vacuum enclosure main body (target housing unit) 3 is not restricted to a case of housing the entirety of the target 5*d*, 47*b*, or 52*c* and includes, for example in a case where the anode 5, 40, or 50 itself is made the target, a state where a part of the target is exposed from the vacuum enclosure main body (target housing unit) 3. In such cases, the inclined surfaces 5*c*, 47*a*, and 52*b* of the anodes 5, 40, and 50 become the electron incidence surfaces of the targets. The anodes 5, 40, and 50 may have shapes that are bent at a middle portion. The vacuum enclosure main body (anode housing unit) 3 is not restricted to a circular, tube-like shape and may have a rectangular shape or other shape instead, and is also not restricted to having a straightly extending tube-like form and may have a curved or bent tube-like form. In a case where the inner tube 13 is not to be provided, a pair of conductive flat portions, in the same structure as the pair of conductive flat portions 13*d* disposed in the inner tube 13, may be disposed directly on an inner wall surface of the head 9.

Figure 20:
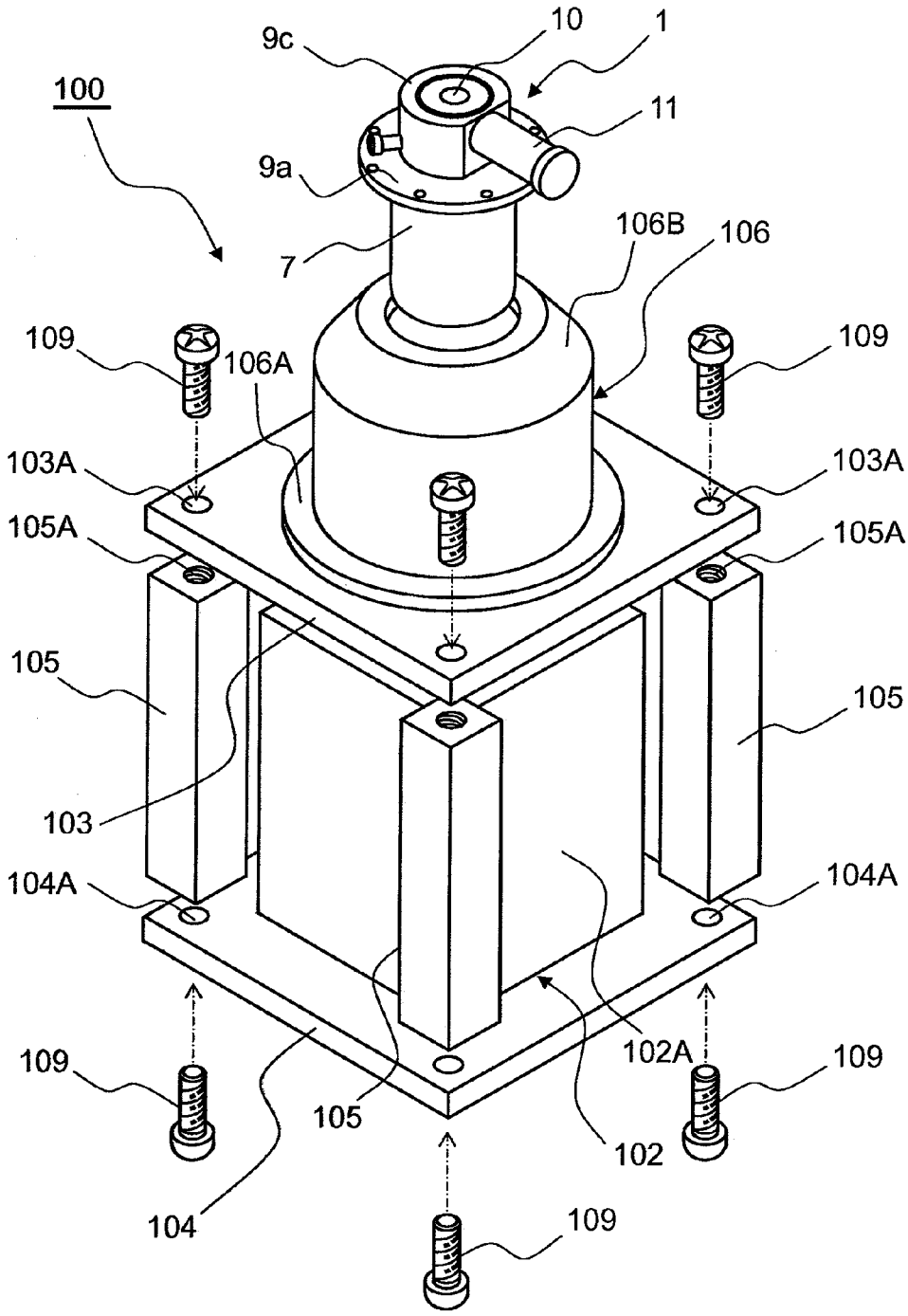
FIG. 20 is an exploded perspective view of an arrangement of an embodiment of an X-ray source according to the present invention.
Figure 21:
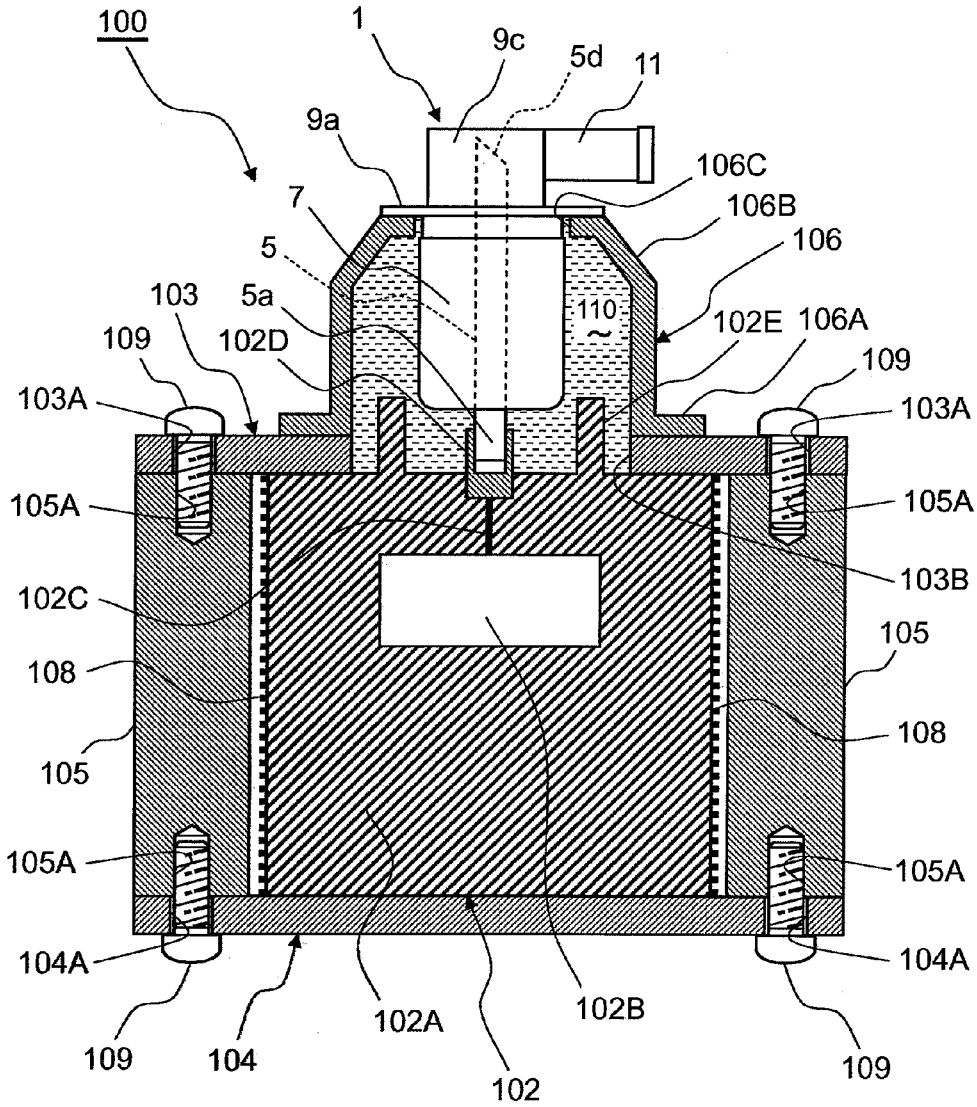
FIG. 21 is a sectional view of an internal structure of the X-ray source according to the embodiment.

An X-ray source 100 according to the present invention, to which an X-ray tube with any of the above-described structures (an X-ray tube according to the present invention) is applied, shall now be described with reference to FIGS. 20 and 21. FIG. 20 is an exploded perspective view of an arrangement of an embodiment of the X-ray source according to the present invention. FIG. 21 is a sectional view of an internal structure of the X-ray source according to the embodiment. Although any of the X-ray tubes 1A to 1C according to the first to third embodiments can be applied to the X-ray source 100 according to the present invention, for the sake of simplicity, all X-ray tubes applicable to the X-ray source 100 shall be expressed simply as "X-ray tube 1" in the description that follows and in the relevant drawings.

As shown in FIGS. 20 and 21, the X-ray source 100 includes a power supply unit 102, a first plate member 103, disposed at an upper surface side of an insulating block 102A of the power supply unit 102, a second plate member 104, disposed at a lower surface side of the insulating block 102A, four fastening spacer members 105, interposed between the first plate member 103 and the second plate member 104, and an X-ray tube 1, fixed above the first plate member 103 via a metal tubular member 106. The power supply unit 102 has a structure, with which a high voltage generating unit 102B, a high voltage line 102C, a socket 102D, etc., (see FIG. 21), are molded inside the insulating block 102A, comprised of an epoxy resin.

The insulating block 102A of the power supply unit 102 has a short, rectangular column shape, with the mutually parallel upper surface and lower surface of substantially square shapes. At a central portion of the upper surface is disposed the cylindrical socket 102D, connected to the high voltage generating unit 102B via the high voltage line 102C. An annular wall portion 102E, positioned concentric to the socket 102D, is also disposed on the upper surface of the insulating block 102A. A conductive coating 108 is applied to peripheral surfaces of the insulating block 102A to make a potential thereof the GND potential (ground potential). A conductive tape may be adhered in place of coating the conductive coating.

The first plate member 103 and the second plate member 104 are members that, for example, act together with the four fastening spacer members 105 and eight fastening screws 109 to clamp the insulating block 102A of the power supply unit 102 in the vertical direction in the figure. The first plate member 103 and the second plate member 104 are formed to substantially square shapes that are larger than the upper surface and the lower surface of the insulating block 102A. Screw insertion holes 103A and 104A, for insertion of the respective fastening screws 109, are formed respectively at four corners of the first plate member 103 and the second plate member 104. A circular opening 103B, surrounding the annular wall portion 102E that protrudes from the upper surface of the insulating block 102A, is formed in the first plate member 103.

The four fastening spacer members 105 are formed to rectangular column shapes and are disposed at the four corners of the first plate member 103 and the second plate member 104. Each fastening spacer member 105 has a length slightly shorter than an interval between the upper surface and the lower surface of the insulating block 102A, that is, a length shorter than the interval by just a fastening allowance of the insulating block 102A. Screw holes 105A, into each of which a fastening screw 109 is screwed, is formed at upper and lower end surfaces of each fastening spacer member 105.

The metal tubular member 106 is formed to a cylindrical shape and has a mounting flange 106A formed at a base end thereof and fixed by screws across a sealing member to a periphery of the opening 103B of the first plate member 103. A peripheral surface at a tip of the metal tubular member 106 is formed to a tapered surface 106B. By the tapered surface 106B, the metal tubular member 106 is formed to a tapered shape without any corner portions at the tip. An opening 106C, through which a bulb 7 of the X-ray tube 1 is inserted, is formed in a flat, tip surface that is continuous with the tapered surface 106B.

The X-ray tube 1 includes the bulb 7, holding and housing the anode 5 in an insulated state, an upper portion 9*c* of the head 9, housing the reflecting type target 5*d* that is made electrically continuous with and formed at an inner end portion of the anode 5, and an electron gun housing unit 11, housing the electron gun 15 that emits an electron beam toward an electron incidence surface (reflection surface) of the target 5*d*. A target housing unit is formed by the bulb 7 and the head 9.

The bulb 7 and the upper portion 9*c* of the head 9 are positioned so as to be matched in tube axis, and these tube axes are substantially orthogonal to a tube axis of the electron gun housing unit 11. A flange 9*a*, for fixing to the tip surface of the metal tubular member 106, is formed between the bulb 7 and the upper portion 9*c* of the head 9. A base end 5*a* (portion at which a high voltage is applied from the power supply unit 102) of the anode 5 protrudes downward from a central portion of the bulb 7 (see FIG. 21).

An exhaust tube is attached to the X-ray tube 1, and a sealed vacuum container is formed by interiors of the bulb 7, the upper portion 9*c* of the head 9, and the electron gun housing unit 11 being depressurized to a predetermined degree of vacuum via the exhaust tube.

In the X-ray tube 1, the base end 5*a* (high voltage application portion) is fitted into the socket 102D molded in the insulating block 102A of the power supply unit 102. High voltage is thereby supplied from the high voltage generating unit 102B and via the high voltage line 102C to the base end 5*a*. When in this state, the electron gun 15, incorporated in the electron gun housing unit 11, emits electrons toward the electron incidence surface of the target 5*d*, X-rays, generated by the incidence of the electrons from the electron gun 15 onto the target 5*d*, are emitted from an X-ray emission window 10, fitted into an opening of the upper portion 9*c* of the head 9.

Here, the X-ray source 100 is assembled, for example, by the following procedure. First, the four fastening screws 109, inserted through the respective screw insertion holes 104A of the second plate member 104, are screwed into the respective screw holes 105A at the lower end surfaces of the four fastening spacer members 105. And by the four fastening screws 109, inserted through the respective screw insertion holes 103A of the first plate member 103, being screwed into the respective screw holes 105A at the upper end surfaces of the four fastening spacer members 105, the first plate member 103 and the second plate member 104 are mutually fastened while clamping the insulating block 102A in the vertical direction. A sealing member is interposed between the first plate member 103 and the upper surface of the insulating block 102A, and likewise, a sealing member is interposed between the second plate member 104 and the lower surface of the insulating block 102A.

A high voltage insulating oil 110, which is a liquid insulating substance, is then injected into an interior of the metal tubular member 106 from the opening 106C of the metal tubular member 106 that is fixed above the first plate member 103. The bulb 7 of the X-ray tube 1 is then inserted from the opening 106C of the metal tubular member 106 into the interior of the metal tubular member 106 and immersed in the high voltage insulating oil 110. In this process, the base end 5*a* (high voltage application portion) that protrudes downward from the central portion of the bulb 7 is fitted into the socket 102D at the power supply unit 102 side. The flange 9*a* of the X-ray tube 1 is then fixed by screwing across the sealing member onto the tip surface of the metal tubular member 106.

In the X-ray source 100, assembled by the above process, the annular wall portion 102E, protruded from the upper surface of the insulating block 102A of the power supply unit 102, and the metal tubular member 106 are positioned concentric to the anode 5 of the X-ray tube 1 as shown in FIG. 21. Also, the annular wall portion 102E protrudes to a height of surrounding and shielding the periphery of the base end 5*a* (high voltage application portion), which protrudes from the bulb 7 of the X-ray tube 1, from the metal tubular member 106.

In the X-ray source 100, when a high voltage is applied to the base end 5*a* of the X-ray tube 1 from the high voltage generating unit 102B of the power supply unit 102 and via the high voltage line 102C and the socket 102D, the high voltage is supplied to the target 5*d* via the anode 5. When in this state, the electron gun 15, housed in the electron gun housing unit 11, emits electrons toward the electron incidence surface of the target 5*d*, housed in the upper portion 9*c* of the head 9, the electrons become incident on the target 5*d*. The X-rays that are thereby generated at the target 5*d* are emitted to the exterior via the X-ray emission window 10, fitted onto the opening of the upper portion 9*c* of the head 9.

Here, in the X-ray source 100, the metal tubular member 106, housing the bulb 7 of the X-ray tube 1 in a state of being immersed in the high voltage insulating oil 110, is protruded from and fixed above the exterior of the insulating block 102A of the power supply unit 2, that is, the first plate member 103. A good heat dissipating property is thus realized, and heat dissipation of the high voltage insulating oil 110 inside the metal tubular member 106 and the bulb 7 of the X-ray tube 1 can be promoted.

The metal tubular member 106 has a cylindrical shape with the anode 5 disposed at the center. In this case, because the distance from the anode 5 to the metal tubular member 106 is made uniform, an electric field formed in a periphery of the anode 5 and the target 5*d* can be stabilized. The metal tubular member 106 can thus effectively discharge charges of the charged high voltage insulating oil 110.

Furthermore, the annular wall portion 102E, protruded on the upper surface of the insulating block 102A of the power supply unit 102, surrounds the periphery of the base end 5*a* (high voltage application portion), protruding from the bulb 7 of the X-ray tube 1, and thereby shields the base end 5*a* from the metal tubular member 106. Abnormal discharge from the base end 5*a* to the metal tubular member 106 is thus prevented effectively.

The X-ray source 100 has the structure with which the insulating block 102A of the power supply unit 102 is clamped between the first plate member 103 and the second plate member 104 that are fastened to each other via the four fastening spacer members 105. This means that conductive foreign objects that can induce discharge and charged foreign objects that can induce disruption of electric field are not present inside the insulating block 102A. Thus, in the X-ray source 100 according to the present invention, unwanted discharge phenomena and electric field disruptions in the power supply unit 102 are suppressed effectively.

Figure 22:
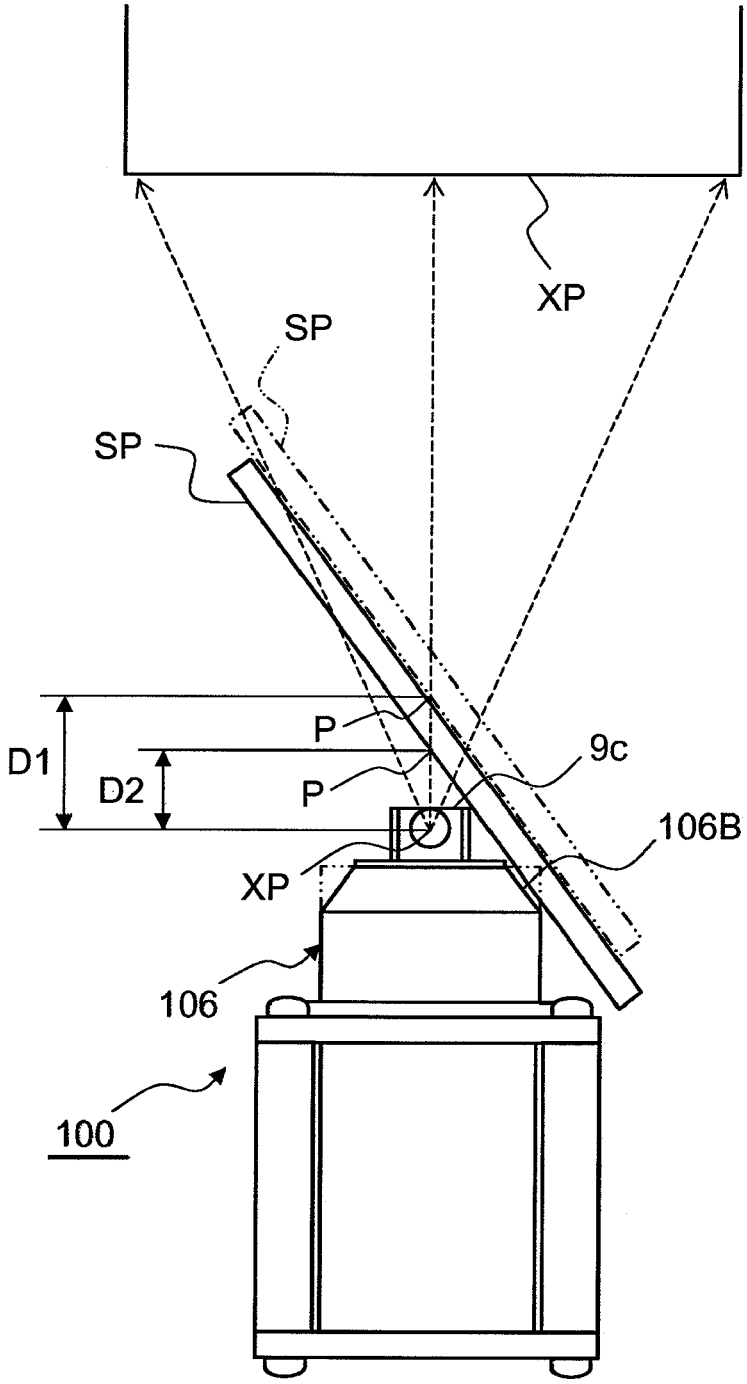
FIG. 22 is a front view for describing actions of the X-ray source (including the X-ray tube according to the embodiment) incorporated in an X-ray generating apparatus of a nondestructive inspection apparatus.

Here, the X-ray source 100 is incorporated and used, for example, in an X-ray generating apparatus that irradiates X-rays onto a sample in a nondestructive inspection apparatus, with which an internal structure of the sample is observed in the form of a transmission image. FIG. 22 is a front view for describing actions of an X-ray source (including the X-ray tube according to the embodiment) that is incorporated, as a usage example of the X-ray source 100, in an X-ray generating apparatus of a nondestructive inspection apparatus.

The X-ray source 100 irradiates X-rays to a sample plate SP, positioned between an X-ray camera XC and the X-ray source 100. That is, the X-ray source 100 irradiates X-rays onto the sample plate SP through the X-ray emission window 10 from an X-ray generation point XP of the target 5*d*, incorporated in the upper portion 9*c* of the head 9 that protrudes above the metal tubular member 106.

In such a usage example, because the shorter the distance from the X-ray generation point XP to the sample plate SP, the greater the magnification factor of the transmission image of the sample plate SP taken by the X-ray camera XC, the sample plate SP is normally positioned close to the X-ray generation point XP. Also, to observe the internal structure of the sample plate SP three-dimensionally, the sample plate SP is inclined around an axis orthogonal to a direction of irradiation of the X-rays.

If, when an observation point P of the sample plate SP is to be observed three-dimensionally upon being brought close to the X-ray generation point XP while inclining the sample plate SP around the axis orthogonal to the direction of irradiation of the X-rays as shown in FIG. 22, corner portions, such as indicated by alternate long and two short dashes lines, are left at a tip of the metal tubular member 106 of the X-ray source 100, the observation point P of the sample plate SP can be made to approach the X-ray generation point XP only up to a distance, with which the sample plate SP contacts a tip corner portion of the metal tubular member 106, that is, only up to a distance at which a distance from the X-ray generating point XP to the observation point P becomes D1.

On the other hand, in the X-ray source 100, with which the tip of the metal tubular member 106 is configured to have a tapered shape without a corner portion by the provision of the tapered surface 106B as shown in FIGS. 20 and 21, the observation point P of the sample plate SP can be made to approach the X-ray generation point XP to a distance, with which the sample plate SP contacts the tapered surface 106B of the metal tubular member 106 as indicated by solid lines FIG. 22, that is, to a distance at which the distance from the X-ray generating point XP to the observation point P becomes D2. As a result, the transmission image of the observation point P of the sample plate SP can be magnified further and nondestructive inspection of the observation point P can be performed more precisely.

The X-ray source 100 according to the present invention is not restricted to the above-described embodiment. For example, although a cross-sectional shape of an inner peripheral surface of the metal tubular member 106 is preferably circular, a cross-sectional shape of an outer peripheral surface of the metal tubular member 106 is not restricted to being circular and may be a rectangular shape or other polygonal shape. In this case, the peripheral surface of the tip of the metal tubular member can be formed to be an inclined surface.

The insulating block 102A of the power supply unit 102 may have a short, cylindrical shape, and the first plate member 103 and the second plate member 104 may correspondingly have disk shapes. The fastening spacer members 105 may have cylindrical shapes and the number thereof is not restricted to four.

From the invention thus described, it will be obvious that the embodiments of the invention may be varied in many ways. Such variations are not to be regarded as a departure from the spirit and scope of the invention, and all such modifications as would be obvious to one skilled in the art are intended for inclusion within the scope of the following claims.

INDUSTRIAL APPLICABILITY

The X-ray tube according to the present invention can be applied as an X-ray generating source in various X-ray imaging apparatuses that are frequently used for nondestructive, noncontact observations.

The invention claimed is:

1. An X-ray tube comprising:

an anode housing unit having an X-ray emission window for taking out X-rays generated therein;

an anode disposed inside said anode housing unit and having an X-ray target; and an electron gun for emitting electrons toward said X-ray target to generate X-rays in a direction from said X-ray target toward said X-ray emission window; and wherein said anode housing unit has a pair of conductive flat portions disposed so as to oppose each other while sandwiching an electron incidence surface of said X-ray target, said pair of conductive flat portions disposed in parallel to a reference plane, said reference plane containing: a first reference line that joins an electron emission exit center of said electron gun and an electron incidence surface center of said X-ray target; and a second reference line that is a straight line intersecting the first reference line on the electron incidence surface of said X-ray target and joins a center of said X-ray emission window and the electron incidence surface center of said X-ray target.

2. An X-ray tube according to claim 1, wherein said anode housing unit comprises a head onto which said electron gun is mounted; and an inner container mounted inside said head and housing a part of said anode so that the electron incidence surface of said X-ray target is positioned in an interior of said inner container, and wherein said pair of conductive flat portions are disposed in said inner container.

3. An X-ray tube according to claim 1, wherein said anode comprises a main body extending along a predetermined axis; and a protruding portion extending along the axis line of said main body from a tip of said main body, and wherein the electron incidence surface of said X-ray target is formed on said protruding portion.

4. An X-ray tube according to claim 1, wherein the electron emission exit of said electron gun, facing said X-ray target, has a circular shape.

5. An X-ray source comprising:

an X-ray tube according to claim 1; and a power supply unit supplying a voltage for generating X-rays to said X-ray target.

* * * * *